US006720716B2

(12) United States Patent
Shibata et al.

(10) Patent No.: US 6,720,716 B2
(45) Date of Patent: Apr. 13, 2004

(54) SPARK PLUG AND METHOD FOR MANUFACTURING THE SAME

(75) Inventors: Masamichi Shibata, Toyota (JP); Teiji Ishinada, Chiryu (JP); Hiromi Hiramatsu, Kariya (JP)

(73) Assignee: Denso Corporation (JP)

( * ) Notice: Subject to any disclaimer, the term of this patent is extended or adjusted under 35 U.S.C. 154(b) by 87 days.

(21) Appl. No.: 09/994,602

(22) Filed: Nov. 27, 2001

(65) Prior Publication Data

US 2002/0067111 A1 Jun. 6, 2002

(30) Foreign Application Priority Data

Dec. 4, 2000 (JP) ..... 2000-368841
Feb. 23, 2001 (JP) ..... 2001-048713
Oct. 15, 2001 (JP) ..... 2001-317023

(51) Int. Cl.[7] ..... H01T 13/20
(52) U.S. Cl. ..... 313/141
(58) Field of Search ..... 313/141, 142

(56) References Cited

U.S. PATENT DOCUMENTS 4,109,633 A 8/1978 Mitsudo et al.
4,700,103 A 10/1987 Yamaguchi et al.
4,970,426 A * 11/1990 Bronchart ..... 313/141
5,856,724 A * 1/1999 Chiu et al. ..... 313/141
5,898,257 A 4/1999 Sequerra et al.

FOREIGN PATENT DOCUMENTS

EP 1139529 A2 10/2001
JP 52-36237 3/1977
JP 59 119692 7/1984
JP 59-119692 * 7/1984
JP 61-45583 3/1986

* cited by examiner

*Primary Examiner*—Sandra O'Shea
*Assistant Examiner*—Sumati Krishnan
(74) *Attorney, Agent, or Firm*—Nixon & Peabody PC

(57) ABSTRACT

A ground electrode has a proximal portion fixed to one end of a metallic housing and a distal portion extending toward one end of a center electrode so that an acute angle is formed between a center electrode axis and an axis of the distal portion of the ground electrode. A columnar ground electrode tip is fixed to a ground electrode end surface. The ground electrode tip protrudes from the ground electrode end surface and extends toward the center electrode along an axis crossing with an axis passing the ground electrode end surface. An axis of the center electrode tip is in a cross or skew relationship with an axis of the ground electrode tip.

26 Claims, 12 Drawing Sheets

SPARK PLUG AND METHOD FOR MANUFACTURING THE SAME

BACKGROUND OF THE INVENTION

This invention relates to a spark plug having noble metallic or comparable tips fixed to opposed center and ground electrodes so as to cause spark discharge between them. Furthermore, this invention relates to a method for manufacturing this spark plug.

This kind of spark plug is for example disclosed in the unexamined Japanese patent publication No. 52-36237, as schematically shown in FIGS. 19A and 19B. First, an arrangement shown in FIG. 19A comprises a noble metallic tip (i.e., center electrode tip) J2 fixed to an apical end of a center electrode J1 and a noble metallic tip (i.e., ground electrode tip) J4 fixed to an apical end of a ground electrode J3. The center electrode tip J2 and the ground electrode tip J4 are opposed to each other along an axis of the center electrode J1.

Second, an arrangement shown in FIG. 19B comprises the center electrode tip J2 fixed to an apical end of the center electrode J1 and the ground electrode tip J4 fixed to an apical end of the ground electrode J3. The center electrode tip J2 and the ground electrode tip J4 are opposed to each other along a line normal to the axis of the center electrode J1.

However, according to the arrangement shown in FIG. 19A, the ground electrode J3 is long and therefore the heat releasing ability of ground electrode J3 is insufficient. When subjected to the heat of combustion, the ground electrode J3 will have a high temperature. This worsens the heat resistance and lowers the mechanical strength of the ground electrode J3. Furthermore, the noble metallic tip of the ground electrode will be worn hardly. Accordingly, it is difficult to assure a proper life of the ground electrode.

In general, the flow of gas mixture in a combustion chamber is normal to the axis of a plug (i.e., the axis of center electrode J1) as shown by an arrow Y in FIG. 19B. Such a flow of gas mixture tends to forcibly shift a flame kernel toward the ground electrode J3 when the flame kernel is produced in the discharge gap between the opposed tips J2 and L4 in response to an ignition.

In this case, according to the arrangement of FIG. 19B, the center electrode J1 and the ground electrode J3 are positioned close and parallel to each other. Hence, due to the flow of gas mixture, the flame kernel collides with the ground electrode J3 and is cooled by the ground electrode J3. This worsens the ignitability of a spark plug.

Furthermore, this kind of spark plug is disclosed in the unexamined Japanese patent publication No. 61-45583, as schematically shown in FIG. 20. An arrangement shown in FIG. 20 comprises a ground electrode J6 having a proximal portion fixed to a metallic housing J5 and a distal portion extending toward an apex of center electrode J7 so that an acute angle is formed between an axis of the distal portion of ground electrode J6 and the axis of center electrode J7.

The arrangement shown in FIG. 20 is advantageous in that the ground electrode is short in length and excellent in heat resistance and mechanical strength when compared with an ordinary ground electrode having a distal portion perpendicular to an axis of the center electrode and overhanging an apex of the center electrode (refer to FIG. 19A).

However, according to the arrangement shown in FIG. 20, a ground electrode tip J8 is provided within an area of an end surface J61 of the distal portion of ground electrode J6. A distance J10 between the distal portion of ground electrode J6 and the center electrode tip J9 must be short to form an appropriate discharge gap between the ground electrode tip J8 and the center electrode tip J9.

Accordingly, when the flame kernel is shifted toward the ground electrode J6 due to the flow of gas mixture, the flame kernel is cooled by the ground electrode J6. The ignitability of a spark plug becomes dissatisfactory. Furthermore, as a fixing portion of the ground electrode tip J8 to the ground electrode J6 is positioned close to the center electrode tip J9, a discharge may occur at the fixing portion of the ground electrode tip J8. Thus, the reliability of the tip fixing portion cannot be assured.

SUMMARY OF THE INVENTION

In view of the foregoing problems of the prior art, the present invention has an object to provide a spark plug having noble metallic or comparable tips fixed to opposed center and ground electrodes so as to cause spark discharge between them which is capable of shortening the length of the ground electrode and improving the heat resistance and mechanical strength, and also capable of preventing the discharge from occurring from a tip fixing portion of the ground electrode, thereby assuring the fixing reliability of the tip and realizing excellent ignitability.

To accomplish the above and other related objects, the present invention provides a first spark plug comprising a cylindrical metallic housing, a center electrode accommodated in the metallic housing with one end protruding and extending from one end of the metallic housing, a center electrode tip fixed to the one end of the center electrode and extending in the same direction as an axis of the center electrode, a ground electrode having a proximal portion fixed to the one end of the metallic housing and a distal portion extending toward the one end of the center electrode, and a columnar ground electrode tip fixed to an end surface of the distal portion of the ground electrode with an apical surface of the ground electrode tip opposed to an apical surface of the center electrode tip via a discharge gap. The first spark plug is characterized in that an acute angle is formed between an axis of the distal portion of the ground electrode and the axis of the center electrode when the ground electrode is projected on a virtual plane including the axis of the center electrode and a cross-sectional centroid of a proximal end of the ground electrode where the ground electrode is fixed to the metallic housing. The ground electrode tip extends along an axis crossing with the axis of the distal portion of the ground electrode, so that the ground electrode tip protrudes from the end surface of the distal portion of the ground electrode and extends toward the center electrode. And, an axis of the center electrode tip is in a cross or skew relationship with an axis of the ground electrode tip.

According to the first spark plug, the ground electrode having the proximal portion fixed to one end of the metallic housing has the distal portion extending toward one end of the center electrode so that an acute angle is formed between the axis of the distal portion of the ground electrode and the axis of the center electrode. Thus, it becomes possible to shorten the length of the ground electrode and improve the heat resistance and mechanical strength when compared with an ordinary ground electrode having a distal portion perpendicular to the axis of the center electrode and overhanging an apex of the center electrode.

Furthermore, according to the first spark plug, the columnar ground electrode tip protrudes from the end surface of the distal portion of the ground electrode and extends toward the center electrode in the direction crossing with the axis of the distal portion of the ground electrode. And, the axis of the center electrode tip is in a cross or skew relationship with the axis of the ground electrode tip. Thus, it becomes possible to provide an appropriate distance between the fixing portion of the ground electrode tip and the apical surface of the center electrode tip which is sufficiently longer than a distance between the apical surface of the ground electrode tip and the apical surface of the center electrode tip.

Namely, the distance from the apical surface of the ground electrode tip to the apical surface of the center electrode tip is sufficiently shorter than the distance from the fixing portion of the ground electrode tip to the apical surface of the center electrode tip. This ensures that the discharge only occurs between the apical surfaces of the opposed electrode tips, and therefore prevents the discharge from occurring from the fixing portion of the ground electrode tip.

Furthermore, according to the first spark plug, a distance from the distal portion of the ground electrode to the apical surface of the center electrode tip is so long as not to obstruct the growth of flame kernel caused between the apical surfaces of the opposed electrode tips.

Accordingly, the first spark plug of the present invention is capable of shortening the length of the ground electrode and improving the heat resistance and mechanical strength, and also capable of preventing the discharge from occurring from the fixing portion of the ground electrode tip, thereby assuring the fixing reliability of the tip and realizing excellent ignitability.

According to the first spark plug, it is preferable that a crossing angle between the axis of the center electrode tip and the axis of the ground electrode tip is in an angular range from 5° to 70°.

If the crossing angle is less than 5°, the ground electrode will have substantially the same configuration as that of a conventional one which overhang the center electrode. The heat resistance and mechanical strength will be worsened. On the other hand, if the crossing angle is larger than 70°, the distal portion the ground electrode will be positioned so close to the center electrode tip that the growth of flame kernel is obstructed by the distal portion the ground electrode and therefore the ignitability is worsened.

Furthermore, the present invention provides a second spark plug comprising a cylindrical metallic housing, a center electrode accommodated in the metallic housing with one end protruding and extending from one end of the metallic housing, a center electrode tip fixed to the one end of the center electrode and extending in the same direction as an axis of the center electrode, a ground electrode having a proximal portion fixed to the one end of the metallic housing and a distal portion extending toward the one end of the center electrode so that an acute angle is formed between an axis of the distal portion of the ground electrode and the axis of the center electrode, and a columnar ground electrode tip fixed to an end surface of the distal portion of the ground electrode or fixed to a side surface of the distal portion of the ground electrode facing to the center electrode with an apical surface of the ground electrode tip opposed to an apical surface of the center electrode tip via a discharge gap. The second spark plug is characterized in that the ground electrode tip extends along an axis crossing with the axis of the distal portion of the ground electrode, so that the ground electrode tip protrudes from the end surface of the distal portion of the ground electrode and extends toward the center electrode. A crossing angle between an axis of the center electrode tip and an axis of the ground electrode tip is in an angular range from 5° to 70°. And, a fixing portion of the ground electrode tip to the ground electrode is far from the metallic housing in an axial direction of the center electrode compared with the apical surface of the center electrode tip.

According to the second spark plug, it is preferable that the ground electrode tip protrudes toward the center electrode by a protruding length in a range from 0.3 mm to 1.5 mm with respect to the side surface of the distal portion of the ground electrode.

If the length is less than 0.3 mm, the distal portion of the ground electrode will be located so close to the center electrode tip that the growth of flame kernel is obstructed by the distal portion the ground electrode. On the other hand, if the length is larger than 1.5 mm, the ground electrode tip becomes so long that heat release becomes insufficient and the durability against oxidizing exhaustion becomes weak.

Furthermore, the present invention provides a third spark plug comprising a cylindrical metallic housing, a center electrode accommodated in the metallic housing with one end protruding and extending from one end of the metallic housing, a center electrode tip fixed to the one end of the center electrode and extending in the same direction as an axis of the center electrode, a ground electrode having a proximal portion fixed to the one end of the metallic housing and a distal portion extending toward the one end of the center electrode, and a columnar ground electrode tip fixed to a side surface of the distal portion of the ground electrode facing to the center electrode with an apical surface of the ground electrode tip opposed to an apical surface of the center electrode tip via a discharge gap. The third spark plug is characterized in that an acute angle is formed between an axis of the distal portion of the ground electrode and the axis of the center electrode when the ground electrode is projected on a virtual plane including the axis of the center electrode and a cross-sectional centroid of a proximal end of the ground electrode where the ground electrode is fixed to the metallic housing. And, an axis of the center electrode tip is in a cross or skew relationship with an axis of the ground electrode tip.

The third spark plug is characterized in that the ground electrode tip is fixed to the side surface of the distal portion of the ground electrode facing to the center electrode, and therefore differs from the first spark plug which has the ground electrode tip fixed to the end surface of the distal portion of the ground electrode. According to the third spark plug, the ground electrode tip necessarily protrudes toward the center electrode tip than the fixing portion of the ground electrode tip.

Thus, like the first spark plug, the third spark plug can shorten the length of the ground electrode and improve the heat resistance and mechanical strength.

Furthermore, not only the ground electrode tip is fixed to the side surface of the distal portion of the ground electrode facing to the center electrode but also the axis of the center electrode tip is in a cross or skew relationship with the axis of the ground electrode tip. Thus, it becomes possible to provide an adequate distance between the fixing portion of the ground electrode tip and the apical surface of the center electrode tip which is sufficiently longer than a distance between the apical surface of the ground electrode tip and the apical surface of the center electrode tip.

Hence, like the first spark plug, the third spark plug ensures that the discharge only occurs between the apical surfaces of the opposed electrode tips, and therefore prevents the discharge from occurring from the fixing portion of the ground electrode tip. Furthermore, a distance from the distal portion of the ground electrode to the apical surface of the center electrode tip is so long as not to obstruct the growth of flame kernel caused between the apical surfaces of the opposed electrode tips.

Accordingly, the third spark plug of the present invention is capable of shortening the length of the ground electrode and improving the heat resistance and mechanical strength, and also capable of preventing the discharge from occurring from the fixing portion of the ground electrode tip, thereby assuring the fixing reliability of the tip and realizing excellent ignitability.

Even in the third spark plug, it is preferable that a crossing angle between the axis of the center electrode tip and the axis of the ground electrode tip is in an angular range from 5° to 70°. Furthermore, it is preferable that the ground electrode tip protrudes toward the center electrode by a protruding length in a range from 0.3 mm to 1.5 mm with respect to the side surface of the distal portion of the ground electrode.

Furthermore, the present invention provides a fourth spark plug comprising a cylindrical metallic housing, a center electrode accommodated in the metallic housing with one end protruding and extending from one end of the metallic housing, a center electrode tip fixed to the one end of the center electrode and extending outward from the center electrode, a ground electrode having a proximal portion fixed to the one end of the metallic housing and a distal portion extending toward the one end of the center electrode, and a columnar ground electrode tip fixed to an end surface of the distal portion of the ground electrode with an apical surface of the ground electrode tip opposed to an apical surface of the center electrode tip via a discharge gap. The fourth spark plug is characterized in that an acute angle is formed between an axis of the distal portion of the ground electrode and the axis of the center electrode when the ground electrode is projected on a virtual plane including the axis of the center electrode and a cross-sectional centroid of a proximal end of the ground electrode where the ground electrode is fixed to the metallic housing. The ground electrode tip extends along an axis crossing with the axis of the distal portion of the ground electrode, so that the ground electrode tip protrudes from the end surface of the distal portion of the ground electrode and extends toward the center electrode. And, the axis of the center electrode is in a cross or skew relationship with an axis of the ground electrode tip.

The fourth spark plug is characterized in that the axis of the center electrode tip is not specifically defined with respect to the axis of the center electrode, and therefore differs from the first spark plug which has the axis of the center electrode tip extending in the same direction as the axis of the center electrode. Furthermore, according to the fourth spark plug, the axis of the ground electrode tip is in a cross or skew relationship with the axis of the center electrode.

Thus, like the first spark plug, the fourth spark plug can shorten the length of the ground electrode and improve the heat resistance and mechanical strength.

Furthermore, according to the fourth spark plug, the columnar ground electrode tip protrudes from the end surface of the distal portion of the ground electrode and extends toward the center electrode in the direction crossing with the axis of the distal portion of the ground electrode. And, the axis of the center electrode is in a cross or skew relationship with the axis of the ground electrode tip. Thus, it becomes possible to provide an appropriate distance between the fixing portion of the ground electrode tip and the apical surface of the center electrode tip which is sufficiently longer than the distance between the apical surface of the ground electrode tip and the apical surface of the center electrode tip.

Hence, like the first spark plug, no discharge occurs from the fixing portion of the ground electrode tip and the ground electrode does not obstruct the growth of flame kernel.

Accordingly, the fourth spark plug of the present invention is capable of shortening the length of the ground electrode and improving the heat resistance and mechanical strength, and also capable of preventing the discharge from occurring from the fixing portion of the ground electrode tip, thereby assuring the fixing reliability of the tip and realizing excellent ignitability.

Furthermore, the present invention provides a fifth spark plug comprising a cylindrical metallic housing, a center electrode accommodated in the metallic housing with one end protruding and extending from one end of the metallic housing, a center electrode tip fixed to the one end of the center electrode and extending outward from the center electrode, a ground electrode having a proximal portion fixed to the one end of the metallic housing and a distal portion extending toward the one end of the center electrode, and a columnar ground electrode tip fixed to a side surface of the distal portion of the ground electrode facing to the center electrode with an apical surface of the ground electrode tip opposed to an apical surface of the center electrode tip via a discharge gap. The fifth spark plug is characterized in that an acute angle is formed between an axis of the distal portion of the ground electrode and the axis of the center electrode when the ground electrode is projected on a virtual plane including the axis of the center electrode and a cross-sectional centroid of a proximal end of the ground electrode where the ground electrode is fixed to the metallic housing. And, the axis of the center electrode is in a cross or skew relationship with an axis of the ground electrode tip.

The fifth spark plug is characterized in that the ground electrode tip is fixed to the side surface of the distal portion of the ground electrode facing to the center electrode, and therefore differs from the fourth spark plug which has the ground electrode tip fixed to the end surface of the distal portion of the ground electrode. According to the fifth spark plug, the ground electrode tip necessarily protrudes toward the center electrode tip than the fixing portion of the ground electrode tip.

Accordingly, from the same reason described above, the fifth spark plug of the present invention is capable of shortening the length of the ground electrode and improving the heat resistance and mechanical strength, and also capable of preventing the discharge from occurring from the fixing portion of the ground electrode tip, thereby assuring the fixing reliability of the tip and realizing excellent ignitability.

Even in the fourth or fifth spark plug, it is preferable that a crossing angle between the axis of the center electrode and the axis of the ground electrode tip is in an angular range from 5° to 70°. Furthermore, it is preferable that the ground electrode tip protrudes toward the center electrode by a protruding length in a range from 0.3 mm to 1.5 mm with respect to the side surface of the distal portion of the ground electrode.

When the axis of the center electrode is in a cross or skew relationship with the axis of the ground electrode tip, spark discharge causes non-uniform exhaustion (i.e., uneven wear) on the apical surface of each tip. This will enlarge the discharge gap and shorten the life of a plug.

For example, simply increasing the diameter of a tip (i.e., using a thick tip) will assure a practical level of plug life (e.g., equivalent to 100,000 Km in terms of vehicle traveling distance). However, a thick tip will obstruct the growth of flame kernel during the discharge and accordingly sacrifice the ignitability.

In view of this problem, the inventors of the present invention have conducted experiments to optimize the relationship between opposed electrode tips for assuring a practical level of plug life and for obtaining reliable wear durability.

According to the result of such experiments, in any of the first to third spark plugs, it is preferable that an X axis represents the apical surface of the center electrode tip and a Y axis represents the axis of the center electrode tip in a coordinate plane including both of the axis of the center electrode tip and the axis of the ground electrode tip, with a crossing point of the X axis and the Y axis being an origin (0, 0) of the coordinate plane. And, a point 'A' of the ground electrode tip closest to the center electrode tip is expressed by a coordinate value $(-b/2, \chi)$ when a point 'B' on the apical surface of the center electrode tip closest to the ground electrode is expressed by a coordinate value $(-b, 0)$, where $\chi$ represents a discharge gap. Furthermore, an axial deviation amount between the axis of the center electrode tip and the axis of the ground electrode tip is within $\pm d/2$ in a direction normal to the coordinate plane, and a swing amount of the closest point 'A' is within $\pm d/2$ in a direction parallel to the X axis, wherein 'd' represents a diameter of the ground electrode tip.

This arrangement brings the effect of assuring a practical level of plug life by suppression the wear of the center and ground electrode tips in addition to the effects brought by the first to third spark plugs.

When the discharge gap is 1.05 mm, an enlargement of the discharge gap due to the wear of tips must be less than or equal to 1.4 mm. The spark plug according to the above optimization can suppress such an enlargement of the discharge gap to a value within 1.4 mm during a practical level of plug life.

The above optimization can be also utilized in manufacturing the spark plug of the present invention.

In this case, it is desirable that the center electrode tip has a cylindrical shape with a cross section in a range from 0.07 $mm^2$ to 0.79 $mm^2$, and the ground electrode tip has a cylindrical shape with a cross section in a range from 0.07 $mm^2$ to 1.13 $mm^2$.

If the diameter (the cross section) of each tip is excessively large, the flame kernel will collide the tip. In other words, the growth of flame kernel will be obstructed by the tip. On the other hand, if the diameter (the cross section) of each tip is excessively small, heat release from the tip will be worsened. Exhaustion of tip will be promoted. The above-defined range of the tip diameter is the result optimized through the study of influence given to the ignitability and heat resistance of a tip.

Furthermore, it is preferable that the ground electrode has a tapered shape with a cross-sectional area gradually narrowing with decreasing distance from the end surface. This arrangement effectively reduces an area of the ground electrode contacting with the flame kernel. Accordingly, the ignitability can be improved.

Furthermore, it is preferable that the ground electrode has an outer layer made of a Ni alloy and an inner layer made of a copper or copper alloy. Due to excellent thermal conductivity of a copper or copper alloy, this arrangement effectively improves the heat releasing ability of the ground electrode.

Furthermore, it is preferable that the center electrode tip and said ground electrode tip are made of a Pt alloy including at least one additive selected from the group consisting of Ir, Ni, Rh, W, Pd, Ru and Os. More specifically, a preferable material for the center electrode tip and the ground electrode tip is a Pt alloy containing at least one additive selected from the group consisting of Ir (50 weight % or less), Ni (40 weight % or less), Rh (50 weight % or less), W (30 weight % or less), Pd (40 weight % or less), Ru (30 weight % or less), and Os (20 weight % or less).

Furthermore, it is preferable that the center electrode tip and the ground electrode tip are made of a Ir alloy including at least one additive selected from the group consisting of Rh, Pt, Ni, W, Pd, Ru and Os. More specifically, a preferable material for the center electrode tip and the ground electrode tip is a Ir alloy containing at least one additive selected from the group consisting of Rh (50 weight % or less), Pt (50 weight % or less), Ni (40 weight % or less), W (30 weight % or less), Pd (40 weight % or less), Ru (30 weight % or less), and Os (20 weight % or less).

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENTS

Figure 1:
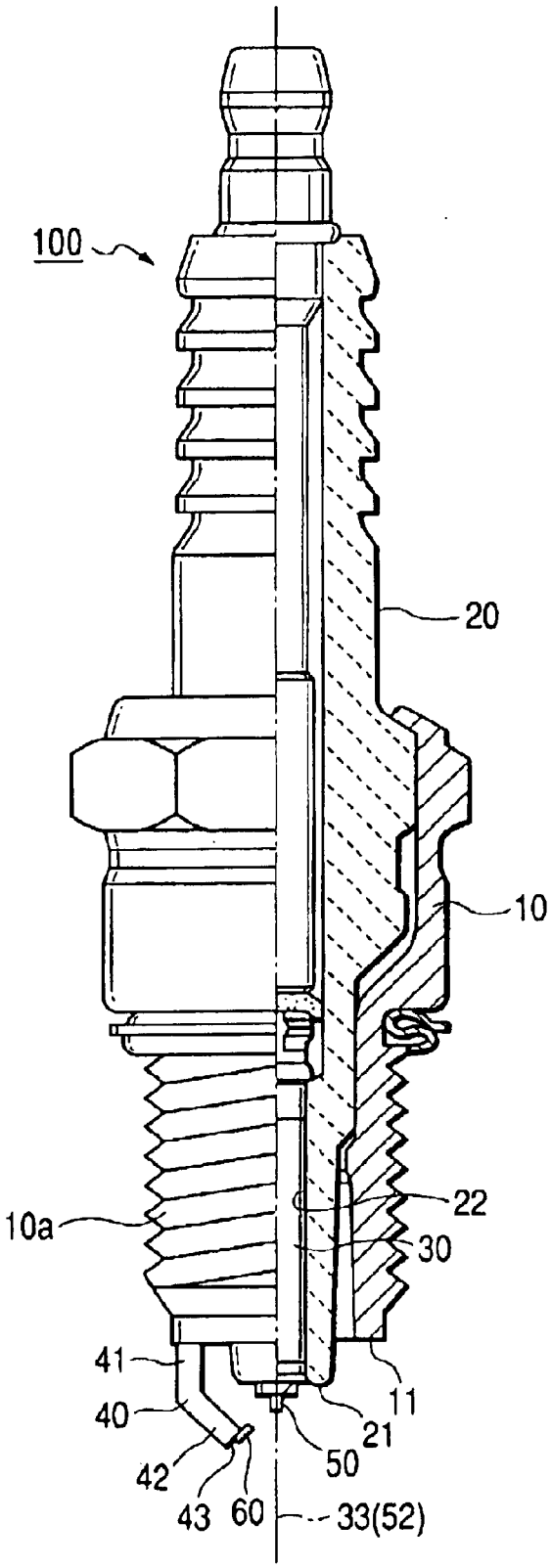
FIG. 1 is a half cross-sectional view showing a spark plug in accordance with a first embodiment of the present invention.

Preferred embodiments of the present invention will be explained hereinafter with reference to attached drawings. Identical parts are denoted by the same reference numerals throughout drawings.

First Embodiment

Figure 2:
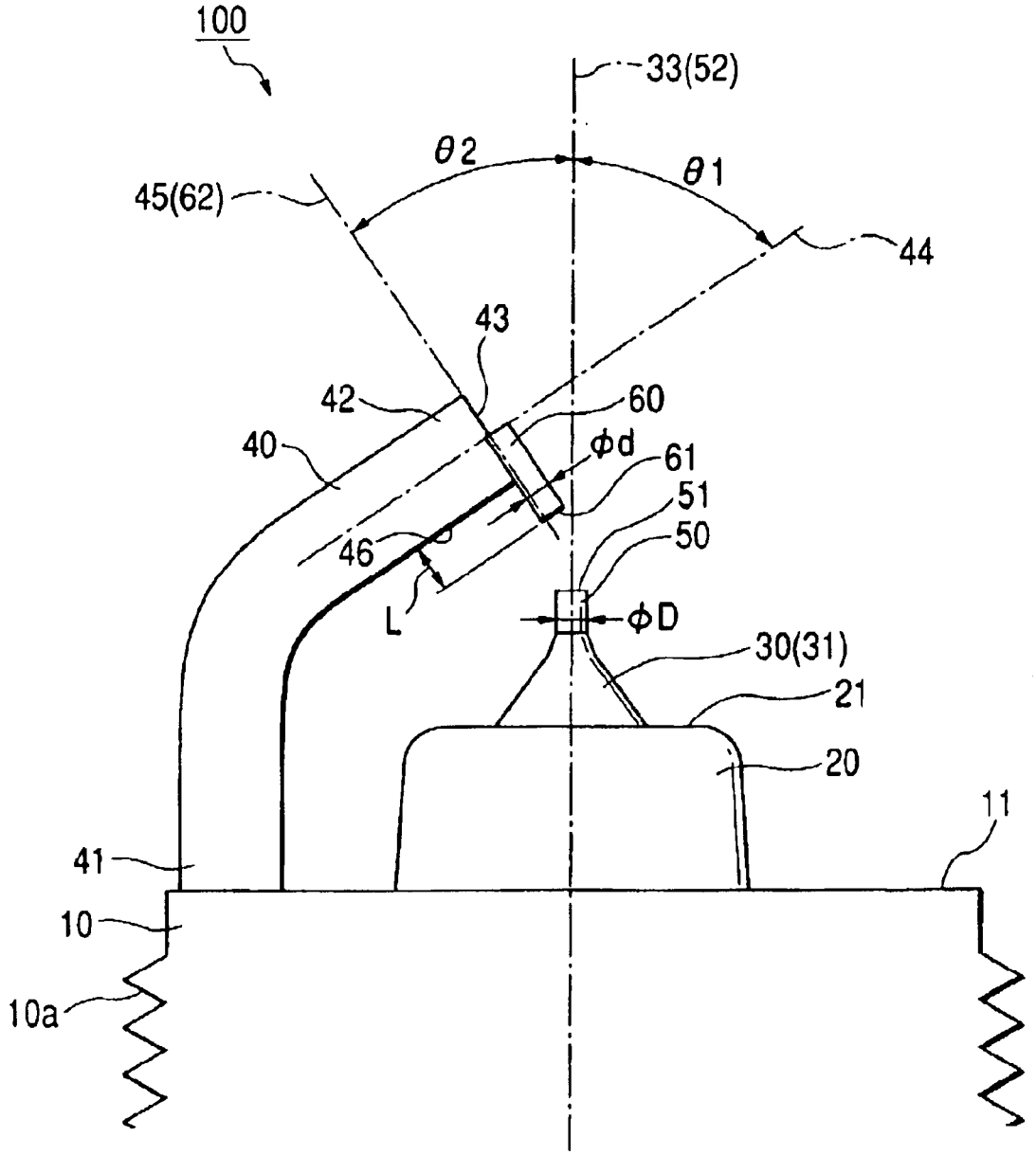
FIG. 2 is an enlarged view showing a spark discharge portion of the spark plug shown in FIG. 1.

A preferred embodiment of the present invention will be explained hereinafter. FIG. 1 is a half cross-sectional view showing a spark plug 100 in accordance with a first embodiment of the present invention. FIG. 2 is an enlarged view showing a spark discharge portion of the spark plug 100 serving as an essential arrangement of the present invention.

The spark plug 100 is applicable to an ignition device of an automotive engine and fixedly inserted into a screw hole opened in an engine head (not shown) defining a combustion chamber of the engine.

The spark plug 100 has a cylindrical metallic housing 10 made of an electrically conductive steel member (e.g., low carbon steel). The metallic housing 10 has a threaded portion 10*a* for securely fixing the spark plug 100 to an engine block (not shown). The metallic housing 10 has an inside space for fixedly holding an insulator 20 made of an alumina ceramic ($Al_2O_3$) or the like. One end 21 of insulator 20 is exposed out of one end 11 of the metallic housing 10.

The insulator 20 has an axial hole 22 for fixedly holding a center electrode 30. Thus, the center electrode 30 is held by the metallic housing 10 via the insulator 20. The center electrode 30 has a cylindrical body consisting of an inner member, such as a copper or comparable metallic member, having excellent thermal conductivity and an outer member, such as a Ni-group alloy or comparable metallic member, having excellent heat resistance and corrosion resistance. As shown in FIG. 2, the center electrode 30 has one end 31 tapered and exposed out of the one end 21 of insulator 20.

A ground electrode 40 has a proximal portion 41 securely fixed to the one end 11 of metallic fitting 10 by welding. The ground electrode 40 is bent at an intermediate portion. A distal portion 42 of ground electrode 40 extends toward the one end 31 of center electrode 30. An acute angle is formed between an axis of the distal portion 42 and an axis 33 of center electrode 30. The ground electrode 40 has a columnar body (e.g., a rectangular rod).

As shown in FIG. 2, an axis 44 of the distal portion 42, crossing with an end surface 43 at the distal end of ground electrode 40, intersects with the center electrode axis 33 with an acute angle θ1. Hereinafter, the end surface 43 of ground electrode 40 is referred to as ground electrode end surface. The ground electrode 40 is made of a Ni-group alloy containing Ni as a chief material.

In this case, a virtual plane is supposed as a plane including the center electrode axis 33 and a cross-sectional centroid of a proximal end of the ground electrode 40 where the ground electrode 40 is fixed (welded) to the metallic housing 10. The axis 44 of the distal portion 42 is defined as an axis substantially crossing the ground electrode end surface 43 when the ground electrode 40 is projected on the virtual plane. In other words, the virtual plane is parallel to the sheet of FIG. 2.

A center electrode tip 50 made of a noble metal or a comparable member is fixed on the one end 31 of center electrode 30 by laser welding or resistance welding. The center electrode tip 50 extends in the same direction as the center electrode axis 33. In other words, according to the disclosed arrangement of this embodiment, the center electrode axis 33 is identical with an axis 52 of the center electrode tip 50. However, this embodiment does not always require that the axes 33 and 52 coincide with each other, and therefore it is also preferable that the center electrode axis 33 is parallel to the axis 52 of the center electrode tip 50.

A columnar ground electrode tip 60 made of a noble metal or a comparable member is fixed to the ground electrode end surface 43. The ground electrode tip 60 extends toward an apical surface 51 of the center electrode tip 50 so that an apical surface 61 of the ground electrode tip 60 is opposed to the apical surface 51 of the center electrode tip 50 via a discharge gap.

The ground electrode tip 60 protrudes outward from a lateral edge of the ground electrode end surface 43 and extends along an axis 45 crossing with the axis 44 of the distal portion passing the ground electrode end surface 43. In other words, according to the disclosed arrangement of this embodiment, the axis 45 is identical with an axis 62 of the ground electrode tip 60.

The axis 52 of the center electrode tip is in a cross or skew relationship with the axis 62 of the ground electrode tip. In practice, a crossing angle θ2 between the axis 52 of the center electrode tip and the axis 62 of the ground electrode tip is in an angular range from 5° to 70°. When the axis 52 of the center electrode tip is in a skew relationship with the axis 62 of the ground electrode tip, a crossing angle between these axes 52 and 62 is similarly expressed by the angle θ2 shown in FIG. 2.

As apparent from FIG. 2, the fixing portion of ground electrode tip 60 to the ground electrode 40 where the ground electrode tip 60 is welded to the ground electrode 40 is far (upward in FIG. 2) from the metallic housing 10 in the direction of the center electrode axis 33 compared with the apical surface 51 of center electrode tip 50.

Furthermore, the ground electrode tip 60 fixed (welded) to the ground electrode end surface 43 protrudes toward the center electrode 30. It is preferable that a protruding length L of the ground electrode tip 60 with respect to a side surface 46 of distal portion 42 of ground electrode 40 facing to the center electrode 30 is in a range from 0.3 mm to 1.5 mm.

The center electrode tip 50 can be configured into a columnar or cylindrical shape. It is preferable the center electrode tip 50 is a rod having a cross section in a range from 0.07 $mm^2$ to 0.79 $mm^2$. According to this embodiment, a preferable diameter of the center electrode tip 50 is in a range from 0.3 mm to 1.0 mm.

Similarly, it is preferable the ground electrode tip 60 is a rod having a cross section in a range from 0.07 $mm^2$ to 1.13 $mm^2$. According to this embodiment, the ground electrode tip 60 has a diameter in a range from 0.3 mm to 1.2 mm.

Furthermore, the center electrode tip 50 and the ground electrode tip 60 are made of a single alloy selected from the group consisting of Pt(i.e., platinum)—Ir(i.e., iridium), Pt—Rh(i.e., rhodium), Pt—Ni(i.e., nickel), Ir—Rh, and Ir—Y(i.e., yttrium).

More specifically, a preferable material for the center electrode tip 50 and the ground electrode tip 60 is a Pt alloy including at least one additive selected from the group consisting of Ir, Ni, Rh, W, Pd, Ru and Os. For example, the tip material is a Pt alloy containing at least one additive selected from the group consisting of Ir (50 weight % or less), Ni (40 weight % or less), Rh (50 weight % or less), W (30 weight % or less), Pd (40 weight % or less), Ru (30 weight % or less), and Os (20 weight % or less).

Alternatively, a preferable material for the center electrode tip 50 and the ground electrode tip 60 is a Ir alloy including at least one additive selected from the group consisting of Rh, Pt, Ni, W, Pd, Ru and Os. For example, the tip material is a Ir alloy containing at least one additive selected from the group consisting of Rh (50 weight % or less), Pt (50 weight % or less), Ni (40 weight % or less), W (30 weight % or less), Pd (40 weight % or less), Ru (30 weight % or less), and Os (20 weight % or less).

The spark plug 100 causes a spark discharge in a discharge gap between the apical surface 51 of center electrode tip 50 and the apical surface 61 of ground electrode tip 60, to ignite the gas (i.e., air-fuel) mixture in the combustion chamber. The ignition by the spark plug 100 causes a flame kernel in the discharge gap which grows throughout the combustion chamber so as to accomplish the combustion of the gas mixture charged in the combustion chamber.

This embodiment is characterized in that the columnar ground electrode 40 has the proximal portion 41 fixed to one end 11 of metallic housing 10 and the distal portion 42 extending toward one end 31 of center electrode 30 so that an acute angle (θ1) is formed between the axis of the distal portion 42 and the center electrode axis 33.

Namely, an acute angle is formed between the axis 44 and the center electrode axis 33 when the ground electrode 40 is projected on the virtual plane including the center electrode axis 33 and the cross-sectional centroid of the proximal end of ground electrode 40 where the ground electrode 40 is fixed (welded) to the metallic housing 10.

Figure 19A:
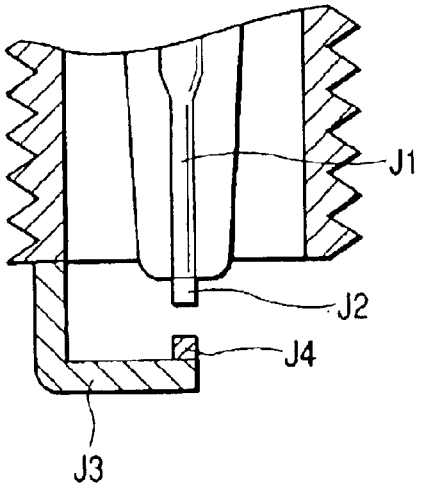
FIG. 19A PRIOR ART
FIGS. 19A and 19B are cross-sectional views explaining a schematic arrangement of a conventional spark plug.

Accordingly, it becomes possible to shorten the length of the ground electrode 40 and improve the heat releasing ability of the ground electrode 40 when compared with an ordinary ground electrode (refer to FIG. 19A) having a distal portion perpendicular to the axis of the center electrode and overhanging an apex of the center electrode. Hence, it becomes possible to assure the heat resistance of the ground electrode 40 and prevent the mechanical strength of the ground electrode 40 from deteriorating.

Shortening the length of ground electrode 40 is not only effective for improving the heat releasing ability of ground electrode 40 but also effective for lowering the temperature of the ground electrode tip 60 fixed on the ground electrode end surface 43. This remarkably reduces the exhaustion of ground electrode tip 60.

Furthermore, according to this embodiment, the columnar ground electrode tip 60 protrudes from the ground electrode end surface 43 and extends toward the center electrode 30 in the direction of axis 45 crossing with the axis 44 of the distal portion passing the ground electrode end surface 43. And, the axis 52 of the center electrode tip is in a cross or skew relationship with the axis 62 of the ground electrode tip.

Thus, as shown in FIG. 2, it becomes possible to provide an appropriate distance between the fixing portion of ground electrode tip 60 and the apical surface 51 of center electrode tip 50 which is sufficiently longer than a distance between the apical surface 61 of ground electrode tip 60 and the apical surface 51 of center electrode tip 50.

Namely, the distance from the apical surface 61 of ground electrode tip 60 to the apical surface 51 of center electrode tip 50 is sufficiently shorter than the distance from the fixing portion of ground electrode tip 60 to the apical surface 51 of center electrode tip 50. This ensures that the discharge only occurs between the apical surfaces 51 and 61 of the opposed electrode tips 50 and 60, and therefore prevents the discharge from occurring from the fixing portion wherein the ground electrode tip 60 is fixed to the ground electrode 40.

Furthermore, according to the arrangement of this embodiment, a distance from the distal portion 42 of ground electrode 40 to the apical surface 51 of center electrode tip 51 is so long that a flame kernel caused between the apical surfaces 51 and 61 of the opposed electrode tips 50 and 60 is not cooled by the ground electrode 40. Thus, this arrangement eliminates the problem that the growth of flame kernel is obstructed by the ground electrode.

Figure 19B:
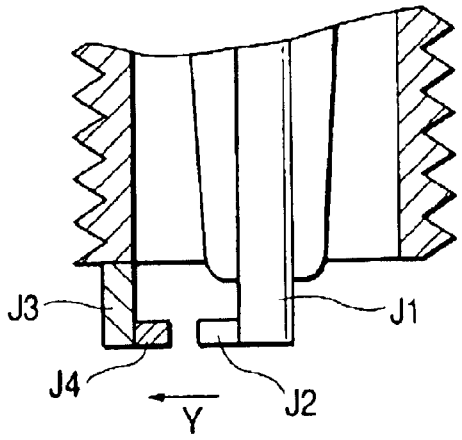
FIG. 19B PRIOR ART
Figure 20:
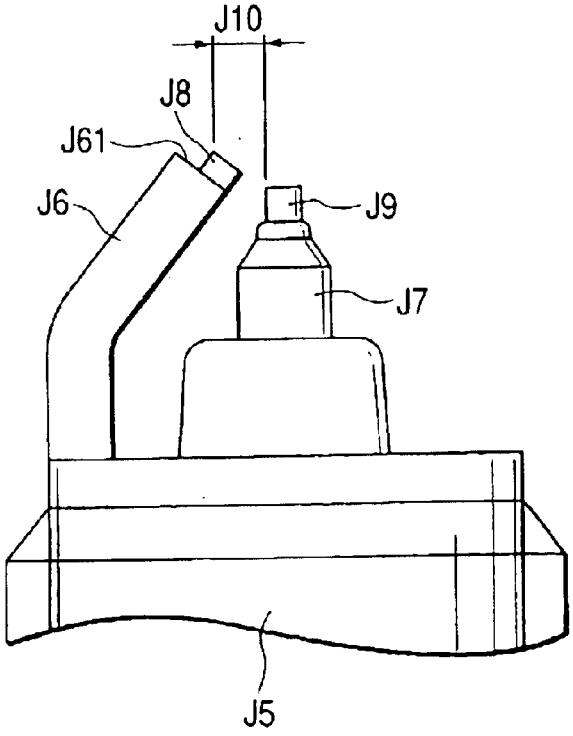
FIG. 20 PRIOR ART
FIG. 20 is a view explaining a schematic arrangement of another conventional spark plug.

In this respect, according to the conventional arrangement shown in FIG. 19B, the ground electrode J3 is short but is parallel and close to the center electrode J1. Thus, the flame kernel collides with the ground electrode J3 and therefore the growth of flame kernel is obstructed by the ground electrode J3.

On the contrary, according to this embodiment, the ground electrode 40 extends so as to form an acute angle between the distal portion 42 and the center electrode axis 33. Furthermore, compared with the conventional arrangement, the ground electrode 40 is offset far from the apical surface 51 of center electrode tip 50 by an amount equivalent to the protruding length L of the ground electrode tip. Therefore, a sufficient space required for the growth of flame kernel is provided between the center electrode tip 50 and the ground electrode 40.

As apparent from foregoing description, this embodiment provides the spark plug 100 capable of shortening the length of the ground electrode 40 and improving the heat resistance and mechanical strength, and also capable of preventing the discharge from occurring from the tip fixing portion of the ground electrode 40, thereby assuring the fixing reliability of the tip 60 and realizing excellent ignitability.

As described above, a desirable value of the crossing angle θ2 between the axes 52 and 62 of opposed electrode tips is in an angular range from 5° to 70°. A desirable value of the ground electrode tip protruding length L is in a range from 0.3 mm to 1.5 mm. A desirable configuration of the center electrode tip 50 is a columnar or cylindrical shape with a cross section in a range from 0.07 $mm^2$ to 0.79 $mm^2$ (equivalent to a diameter in a range from 0.3 mm to 1.0 mm according to this embodiment). And, a desirable configuration of the ground electrode tip 60 is a columnar or cylindrical shape with a cross section in a range from 0.07 $mm^2$ to 1.13 $mm^2$ (equivalent to a diameter in a range from 0.3 mm to 1.2 mm according to this embodiment). These desirable ranges are obtained through the following optimization.

To obtain the practical data, the inventors have conducted various tests to evaluate the ignitability and to check the heat resistance of a ground electrode for the spark plug 100 of this embodiment. The following is the details of the tested spark plug.

A diameter of the threaded portion 10*a* is 14 mm. Each of electrode tips 50 and 60 has a columnar or cylindrical body made of an Ir—Rh alloy. These electrode tips 50 and 60 are fixed to respective electrodes 30 and 40 by laser welding.

The ignitability evaluation test was conducted on a 1,800 cc, 4-cylinder engine under an idling condition with a lean limit A/F (i.e., the leanest air-fuel ratio required for sustaining combustion). On the other hand, the heat resistance test of ground electrode 40 was conducted on a 2,000 cc, 6-cylinder engine at WOT (i.e., fully opened throttle) and 5,600 rpm for 100 hours.

Figure 3A:
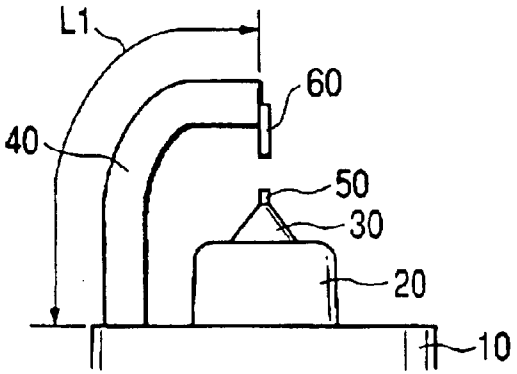
FIGS. 3A to 3E are views showing various examples differentiated in a crossing angle θ2.
Figure 3B:
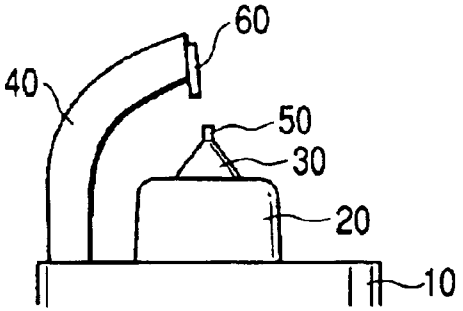
Figure 3C:
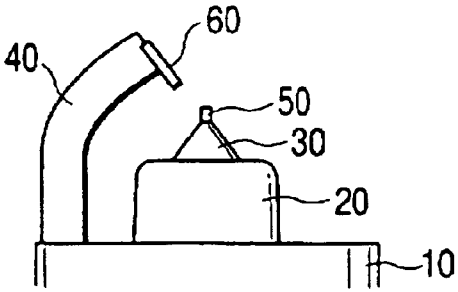
Figure 3D:
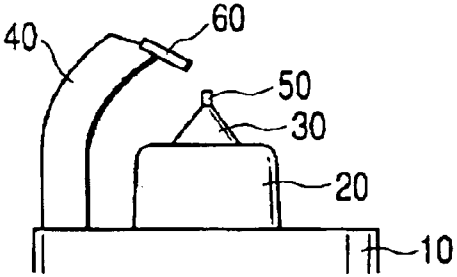
Figure 3E:
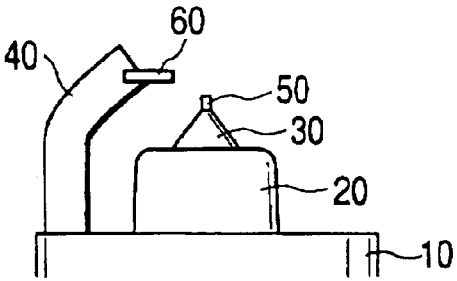

FIGS. 3A to 3E show the tested crossing angle θ2 ranging from 0° to 90°: FIG. 3A=0° (comparable example); FIG. 3B=10°; FIG. 3C=45°; FIG. 3D=70°; and FIG. 3E=90°.

Figure 4:
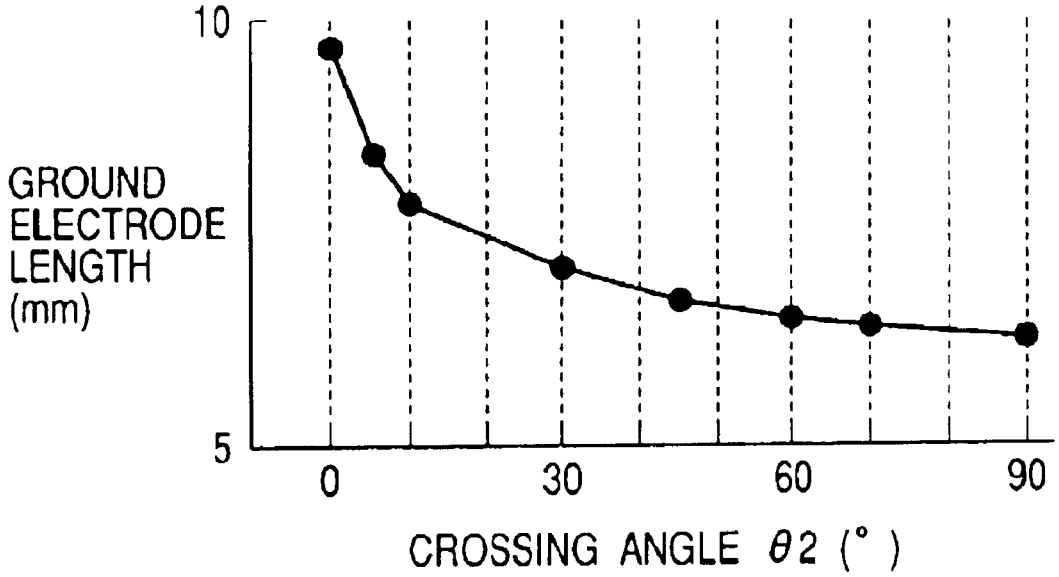
FIG. 4 is a graph showing a relationship between crossing angle θ2 and length of a ground electrode.

FIG. 4 is a graph showing a relationship between the crossing angle θ2(°) and the length (L1 shown in FIG. 3A, mm) of ground electrode 40. As understood from FIG. 4, the ground electrode 40 of the spark plug 100 becomes short with increasing crossing angle θ2.

When the heat resistance test of ground electrode 40 is conducted, an oxidized layer is formed on a surface of the distal portion 42 of the ground electrode 40 due to thermal oxidation. The heat resistance and mechanical strength of the ground electrode deteriorates with increasing depth of this oxidized layer.

Figure 5:
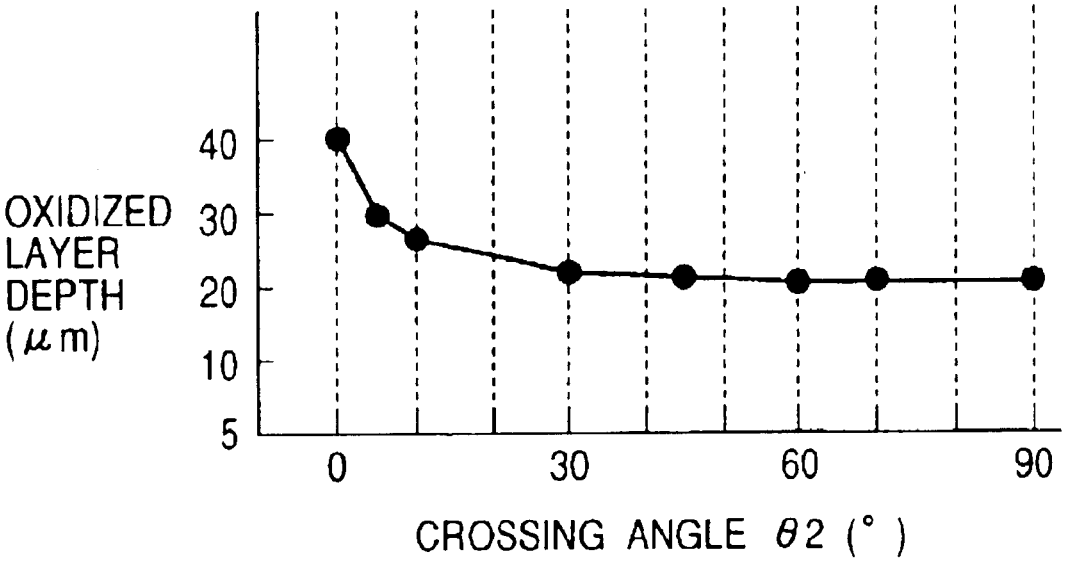
FIG. 5 is a graph showing a relationship between crossing angle θ2 and depth of an oxidized layer formed on an apex of the ground electrode.

FIG. 5 is a graph showing a relationship between the crossing angle θ2(°) and the depth (μm) of the oxidized layer of proximal portion 42 of ground electrode 40 (i.e., the depth of an oxidized layer formed on an apex of the ground electrode) in the heat resistance test for the ground electrode. In this case, both of center electrode tip 50 and ground electrode tip 60 has a columnar or cylinder body with a diameter of 0.4 mm (equivalent to a cross section of 0.13 $mm^2$).

As understood from FIG. 5, the depth of the oxidized layer can be greatly decreased when the crossing angle θ2 exceeds 5°. In other words, the heat resistance and mechanical strength of ground electrode 40 is greatly improved by setting the crossing angle θ2 to such an angle exceeding 5°. It is believed that such improvement is brought by reduction of the length of ground electrode 40 (refer to FIG. 4).

Figure 6:
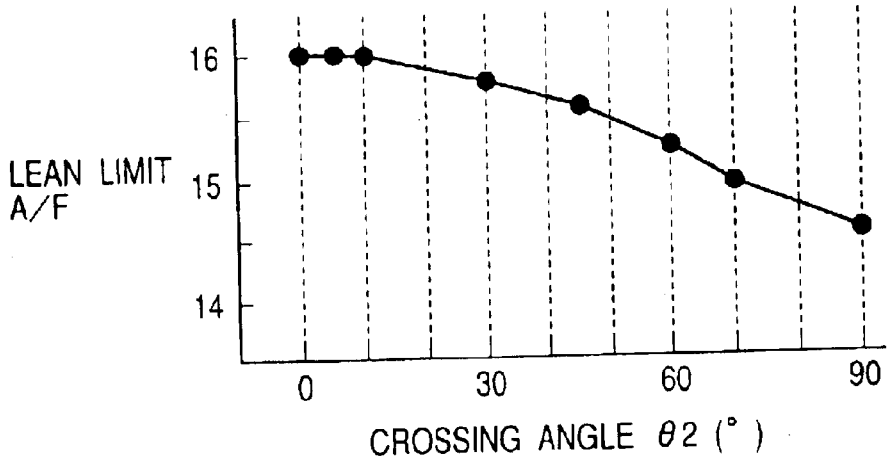
FIG. 6 is a graph showing a relationship between crossing angle θ2 and lean limit A/F.

Furthermore, the ignitability evaluation test was conducted by varying the crossing angle θ2. FIG. 6 is a graph showing a relationship between crossing angle θ2 (°) and lean limit A/F in the ignitability evaluation test. As understood from FIG. 6, the ignitability is greatly improved when the crossing angle θ2 is less than or equal to 70°.

As described as the conventional problem, a flame kernel produced in the discharge gap is forcibly shifted toward the ground electrode 40 due to the flow of gas mixture normal to the center electrode axis 33 in the combustion chamber. When the crossing angle θ2 is large, the distal portion 42 of ground electrode 40 is positioned so close to the center electrode 50 that the growth of flame kernel is obstructed by the distal portion 42 of ground electrode 40. This phenomenon is remarkable when the crossing angle θ2 exceeds 70°.

Furthermore, when the distal portion 42 of ground electrode 40 is positioned so close to the center electrode 50, a discharge may occur undesirably from a tip fixing portion. Exhaustion of the tip fixing portion will be increased, and the reliability of tip fixing portion will be worsened.

Considering the test results shown in FIGS. 4 to 6, it is concluded that a desirable value of crossing angle θ2 is in the range from 5° to 70°, more preferably in a range from 10° to 60°.

Figure 7:
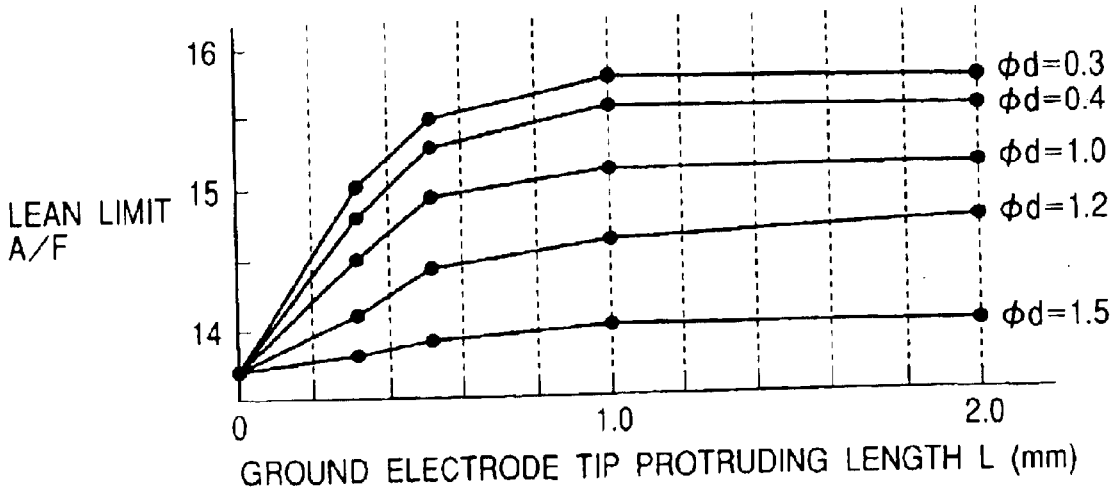
FIG. 7 is a graph showing a relationship between protruding length of a ground electrode tip and lean limit A/F.

The ignitability evaluation test was conducted on various test samples of cylindrical ground electrode tip 60 which are differentiated in both tip diameter φD and the above-described protruding length L although the crossing angle θ2 is fixed to 45°. The center electrode tip 50 used in this test has a cylindrical body with a diameter of 0.4 mm. FIG. 7 shows the result of this ignitability evaluation test.

In FIG. 7, an abscissa represents the protruding length L (mm) of the ground electrode tip and an ordinate represents a lean limit A/F attained in each tip diameter φD. As understood from FIG. 7, excellent ignitability is assured when the ground electrode tip 60 has the protruding length L exceeding 0.3 mm and the diameter φD not larger than 1.2 mm (equivalent to a columnar shape having a cross section not larger than 1.13 $mm^2$).

It is believed that, when the protruding length L is less than 0.3 mm, the distal portion 42 of ground electrode 40 is positioned so close to the center electrode tip 50 that the growth of flame kernel is obstructed by the distal portion 42 of ground electrode 40. On the other hand, when the protruding length L is larger than 1.2 mm, the growth of flame kernel is obstructed by the ground electrode tip 60.

When the protruding length L is larger than or equal to 1.5 mm, the length of ground electrode tip 60 becomes so long that heat releasing ability is worsened. When the diameter of ground electrode tip 60 is less than 0.3 mm (equivalent to a columnar shape having a cross section not larger than 0.07 $mm^2$), the ground electrode tip 60 becomes so thin that heat releasing ability is worsened. The temperature of ground electrode tip 60 itself is increased so high that the ground electrode tip 60 is subjected to severe oxidizing exhaustion. Thus, it cannot be used in practice.

Accordingly, it is preferable that the protruding length L of the ground electrode tip is in the range from 0.3 mm to 1.5 mm and the ground electrode tip 60 has a cylindrical body with a diameter in the range from 0.3 mm to 1.2 mm, i.e., with a cross section in the range from 0.07 $mm^2$ to 1.13 $mm^2$.

Furthermore, it is more preferable that protruding length L of the ground electrode is in a range from 0.5 mm to 1.0 mm and the ground electrode tip 60 has a diameter in a range from 0.4 mm to 1.0 mm, i.e., a cross section in the range from 0.13 $mm^2$ to 0.79 $mm^2$.

Figure 8:
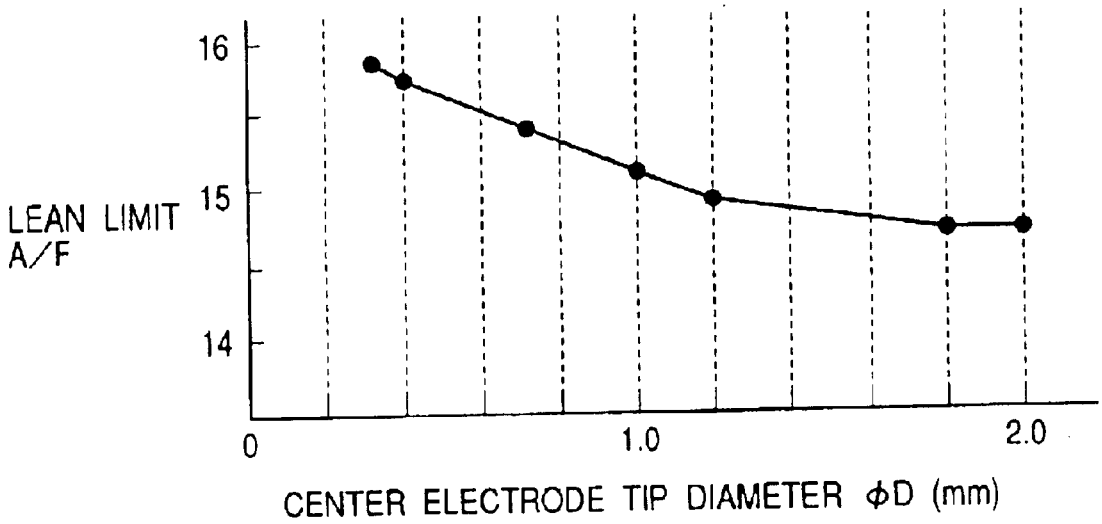
FIG. 8 is a graph showing a relationship between diameter of a center electrode tip and lean limit A/F.

Next, the ignitability evaluation test was conducted on various test samples of cylindrical (or disc-like) center electrode tip 50 which are differentiated in tip diameter φD although the crossing angle θ2 is fixed to 45°. The ground electrode tip 60 used in this test has a cylindrical body with a diameter of 0.4 mm. The protruding length L of ground electrode tip 60 is 1.0 mm. FIG. 8 is the test result showing a relationship between the diameter φD of center electrode tip 50 and lean limit A/F.

As understood from FIG. 8, excellent ignitability is assured when the diameter φD of center electrode tip 50 is less than or equal to 1.0 mm (equivalent to a columnar shape having a cross section not larger than 0.79 $mm^2$). When the diameter φD of center electrode tip 50 exceeds s1.0 mm, a flame kernel collides with the center electrode tip 50 and accordingly the growth of flame kernel is obstructed by the center electrode tip 50.

When the diameter φD of center electrode tip 50 is less than 0.3 mm (equivalent to a columnar shape having a cross section not larger than 0.07 $mm^2$), the center electrode tip 50 becomes so thin that heat releasing ability is worsened. The temperature of center electrode tip 50 itself is increased so high that the center electrode tip 50 is subjected to severe oxidizing exhaustion. Thus, it cannot be used in practice. In view of the foregoing, it is preferable that the center electrode tip 50 has a cylindrical body with a diameter in the range from 0.3 mm to 1.0 mm (i.e., a cross section in the range from 0.07 $mm^2$ to 0.79 $mm^2$).

Second Embodiment

Figure 9:
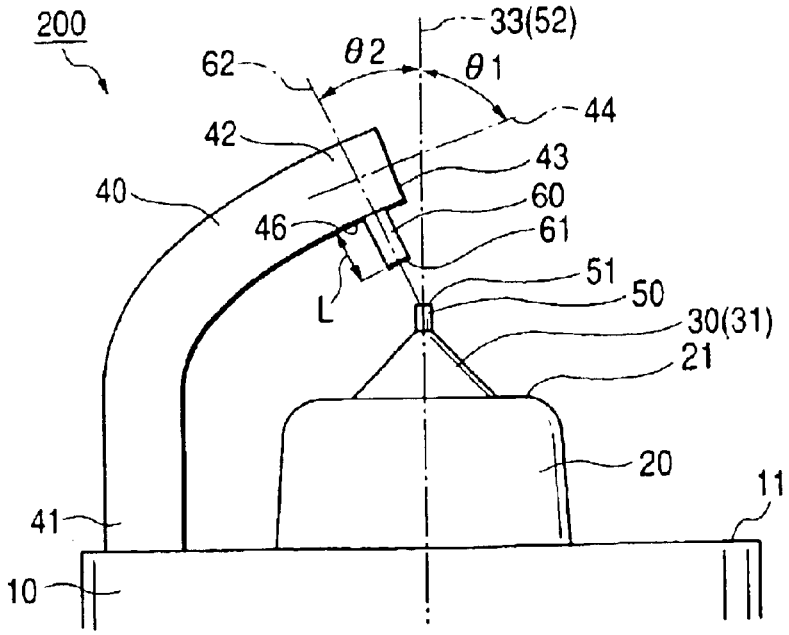
FIG. 9 is an enlarged view showing a spark discharge portion of a spark plug in accordance with a second embodiment of the present invention.

FIG. 9 is an enlarged view showing a spark discharge portion of a spark plug 200 in accordance with a second embodiment of the present invention. The spark plug 200 is characterized in that the ground electrode tip 40 is fixed to a side surface 46 of the distal portion 42 of ground electrode 40 facing to the center electrode 30, and therefore differs from the spark plug 100 of the first embodiment which has the ground electrode tip 60 fixed to the end surface 43 of the distal portion 42 (i.e., ground electrode end surface) of ground electrode 40.

According to the second embodiment, the ground electrode tip 60 necessarily protrudes toward the center electrode tip 50 than the fixing portion of the ground electrode 40. Namely, the ground electrode tip 60 protrudes outward from a lateral edge of the ground electrode end surface 43.

According to the second embodiment, the length of ground electrode 40 becomes somewhat short compared with the first embodiment that comprises the ground electrode tip 60 fixed to the ground electrode end surface 43. However, when compared with an ordinary ground electrode having a distal portion perpendicular to the axis of the center electrode and overhanging an apex of the center electrode, the spark plug of the second embodiment can shorten the length of ground electrode 40 and improve the heat resistance and mechanical strength.

Furthermore, not only the ground electrode tip 60 is fixed to the side surface 46 of the distal portion 42 of ground electrode 40 facing to the center electrode 30 but also the axis 52 of the center electrode tip is in a cross or skew relationship with the axis 45 of the ground electrode tip. Thus, it becomes possible to provide an adequate distance between the fixing portion of the ground electrode tip 60 and the apical surface 51 of the center electrode tip 50 which is sufficiently longer than a distance between the apical surface 61 of ground electrode tip 60 and the apical surface 51 of center electrode tip 50.

Hence, like the first embodiment, the arrangement of the second embodiment ensures that the discharge only occurs between the apical surfaces 51 and 61 of the opposed electrode tips 50 and 60, and therefore prevents the discharge from occurring from the fixing portion of the ground electrode tip 60. Furthermore, a distance from the distal portion 42 of ground electrode 40 to the apical surface 51 of center electrode tip 50 is so long as not to obstruct the growth of flame kernel caused between the apical surfaces 51 and 61 of the opposed electrode tips 50 and 60.

Accordingly, the second embodiment provides the spark plug capable of shortening the length of ground electrode 40 and improving the heat resistance and mechanical strength, and also capable of preventing the discharge from occurring from the tip fixing portion of ground electrode 40, thereby assuring the fixing reliability of the tip 60 and realizing excellent ignitability.

In this case, like the first embodiment, it is desirable that the crossing angle θ2 between the center electrode axis 33 and the ground electrode tip axis 62 is in the range from 5° to 70°. The protruding length L of the ground electrode tip is in the range from 0.3 mm to 1.5 mm.

In short, what is concluded from the second embodiment is that the ground electrode tip 60 can be fixed not only to the end surface 43 of the distal portion 42 of ground electrode 40 but also to the side surface 46 of the distal portion 42 facing the center electrode 30. In both cases, the ground electrode tip 60 can be disposed to protrude from the tip fixing portion and extend in the direction of the axis crossing with the axis 44 passing the ground electrode end surface 43 toward the center electrode 30. The axis 52 of the center electrode tip can be set in a cross or skew relationship with the axis 45 of the ground electrode tip.

Third Embodiment

Figure 10:
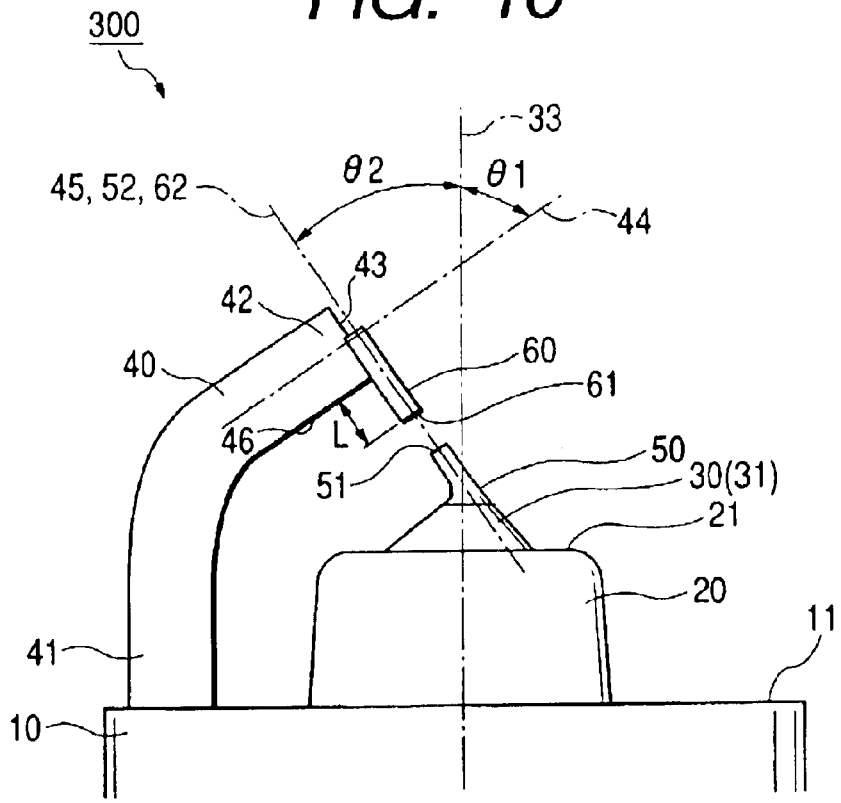
FIG. 10 is an enlarged view showing a spark discharge portion of a spark plug in accordance with a third embodiment of the present invention.

FIG. 10 is an enlarged view showing a spark discharge portion of a spark plug 300 in accordance with a third embodiment of the present invention. The spark plug 300 is characterized in that the axis 52 of the center electrode tip 50 is different from the center electrode axis 33, and therefore differs from the spark plug 100 of the first embodiment which has the axis 52 of the center electrode tip extending in the same direction as the center electrode axis 33. Furthermore, according to the third embodiment, the axis 62 of the ground electrode tip is in a cross or skew relationship with the center electrode axis 33.

Like the first embodiment, according to the third embodiment, the ground electrode 40 has a proximal portion 41 fixed to one end 11 of metallic housing 10 and a distal portion 42 extending toward one end 31 of center electrode 30 so that an acute angle is formed between the axis of the distal portion 42 and the center electrode axis 33. Thus, the third embodiment makes it possible to shorten the length of ground electrode 40 and improve the heat resistance and mechanical strength.

Furthermore, according to the arrangement of the third embodiment, the columnar ground electrode tip 60 protrudes from the ground electrode end surface 43 and extends toward the center electrode 30 in the direction of the axis 45 crossing the axis 44 passing the ground electrode end surface 43. And, the center electrode axis 33 is in a cross or skew relationship with the axis 62 of the ground electrode tip. Thus, as shown in FIG. 10, it becomes possible to provide an appropriate distance between the fixing portion of the ground electrode tip 60 and the apical surface 51 of center electrode tip 50 which is sufficiently longer than the distance between the apical surface 61 of ground electrode tip 60 and the apical surface 51 of center electrode tip 50.

Hence, like the spark plug 100 of the first embodiment, no discharge occurs from the fixing portion of the ground electrode tip 60 and the ground electrode 40 does not obstruct the growth of flame kernel. Accordingly, the third embodiment provides the spark plug capable of shortening the length of ground electrode 40 and improving the heat resistance and mechanical strength, and also capable of preventing the discharge from occurring from the tip fixing portion of ground electrode 40, thereby assuring the fixing reliability of the tip 60 and realizing excellent ignitability.

In this case, like the first embodiment, it is desirable that the spark plug 300 has the crossing angle θ2 is in the range from 5° to 70° and the protruding length L of the ground electrode tip in the range from 0.3 mm to 1.5 mm.

Fourth Embodiment

Figure 11:
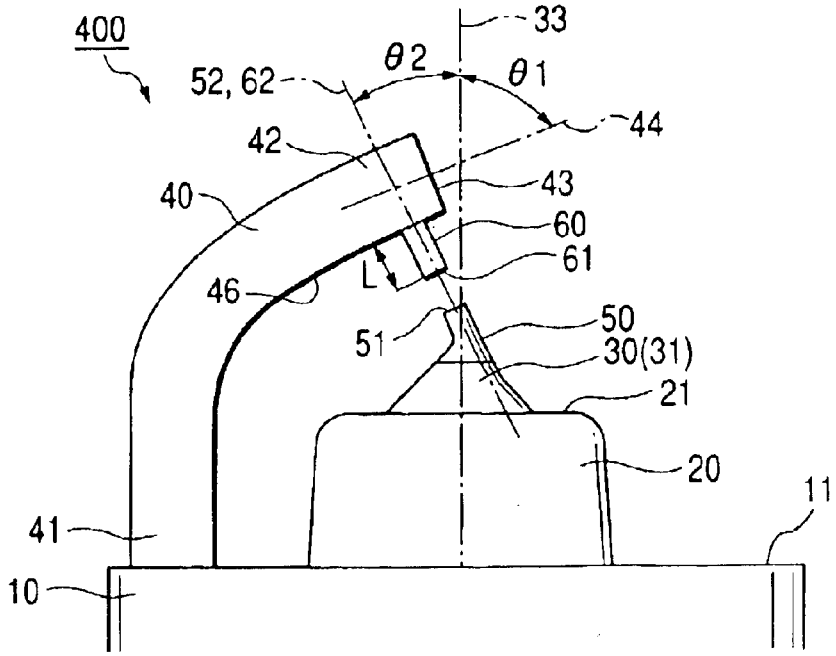
FIG. 11 is an enlarged view showing a spark discharge portion of a spark plug in accordance with a fourth embodiment of the present invention.

FIG. 11 is an enlarged view showing a spark discharge portion of a spark plug 400 in accordance with a fourth embodiment of the present invention. The fourth embodiment is a combination of the second embodiment and the third embodiment.

As shown in FIG. 11, the fourth embodiment differs from the first embodiment in that the ground electrode tip 60 is fixed to the side surface 46 of the distal portion 42 of ground electrode 40 facing to the center electrode 30 and the direction of axis 52 of the center electrode tip is different from the center electrode axis 33. The axis 62 of the ground electrode tip is in a cross or skew relationship with the center electrode axis 33.

From the same reason described above, the spark plug 400 can shorten the length of ground electrode 40 and improve the heat resistance and mechanical strength, and also prevent the discharge from occurring from the tip fixing portion of ground electrode 40, thereby assuring the fixing reliability of ground electrode tip 60 and realizing excellent ignitability.

In this case, like the first embodiment, it is desirable that the spark plug 400 has the crossing angle θ2 is in the range from 5° to 70° and the protruding length L of the ground electrode tip in the range from 0.3 mm to 1.5 mm.

In short, what is concluded from the third and fourth embodiments is that the axis 52 of the center electrode tip needs not be specifically defined with respect to the center electrode axis 33, required thing is only that the center electrode tip extends outward from the center electrode. In this case, it is required that the axis 62 of the ground electrode tip is in a cross or skew relationship with the center electrode axis 33.

Fifth Embodiment

Figure 12:
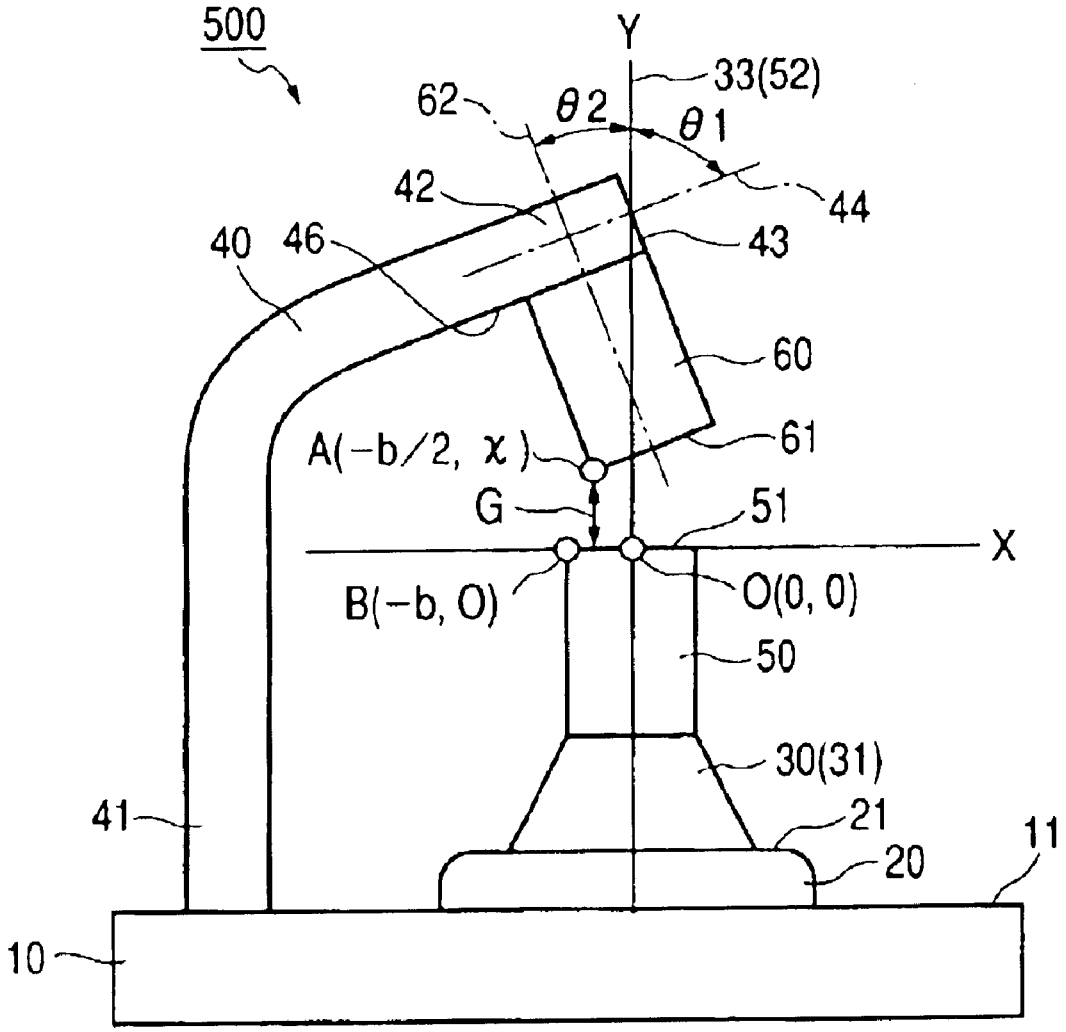
FIG. 12 is an enlarged view showing a spark discharge portion of a spark plug in accordance with a fifth embodiment of the present invention.

FIG. 12 is an enlarged view showing a spark discharge portion of a spark plug 500 in accordance with a fifth embodiment of the present invention.

Like the first and second embodiments, according to the fifth embodiment, the axis 52 of center electrode tip extends in the same direction as the center electrode axis 33 while the axis 62 of ground electrode tip is in a cross or skew relationship with the center electrode axis 33. The fifth embodiment is characterized in that a positional relationship between the opposed tips 50 and 60 is defined on specific coordinates. According to a disclosed example, the ground electrode tip 60 is fixed to the side surface 46 of the distal portion 42 of ground electrode 40 facing to the center electrode 30.

More specifically, the fifth embodiment determines the coordinates in the following manner. An X axis represents the apical surface 51 of center electrode tip 50 and a Y axis represents the axis 52 of center electrode tip 50 in a coordinate plane including both of the axis 52 of center electrode tip 50 and the axis 62 of ground electrode tip 60. A crossing point O of the X axis and the Y axis is an origin (0, 0) of the coordinate plane.

This coordinate plane is expressed by the unit of 'mm', wherein a point 'A' of the ground electrode tip 60 closest to the center electrode tip 50 is expressed by a coordinate value (−b/2, χ) when a point 'B' on the apical surface 51 of the center electrode tip 50 closest to the ground electrode 40 is expressed by a coordinate value (−b, 0), where χ represents a discharge gap G.

According to this embodiment, both of the electrode tips 50 and 60 have a columnar or cylindrical body. The closest point 'A' positioned at the edge of the apical surface 61 of ground electrode tip 60 is offset toward the ground electrode 40 from the center electrode tip axis 52 on the apical surface 51 of center electrode tip 50 by an amount equivalent to ½ of the radius 'b' of center electrode tip 50. Meanwhile, the closest point 'A' is spaced from the apical surface 51 of center electrode tip 50 along the center electrode tip axis 52 by an amount χ representing the discharge gap G.

Figure 13A:
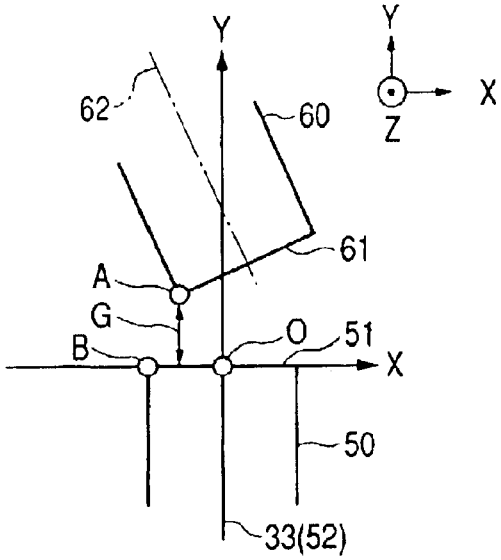
FIGS. 13A to 13D are views explaining an axial deviation amount and a swing amount.
Figure 13B:
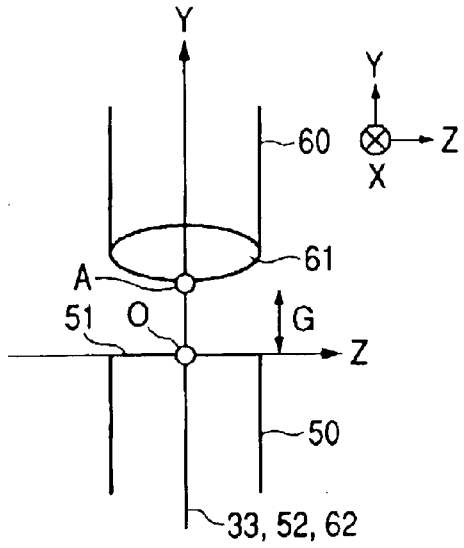

FIGS. 13A to 13D explain the tolerance with respect to an axial deviation amount and a swing amount between the center electrode tip 50 and the ground electrode tip 60 in the above-defined positional relationship. FIG. 13A is an enlarged view showing the vicinity of point O shown in FIG. 12. FIG. 13B is a side view of the vicinity of point O seen from the right side of FIG. 13A. In FIG. 13B, a Z axis is defined as an axis normal to both of the above-defined coordinate plane. Namely, the Z axis is perpendicular to the sheet of FIG. 12.

Figure 13C:
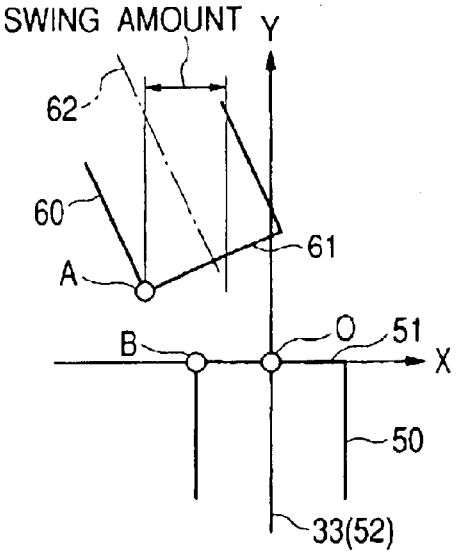
Figure 13D:
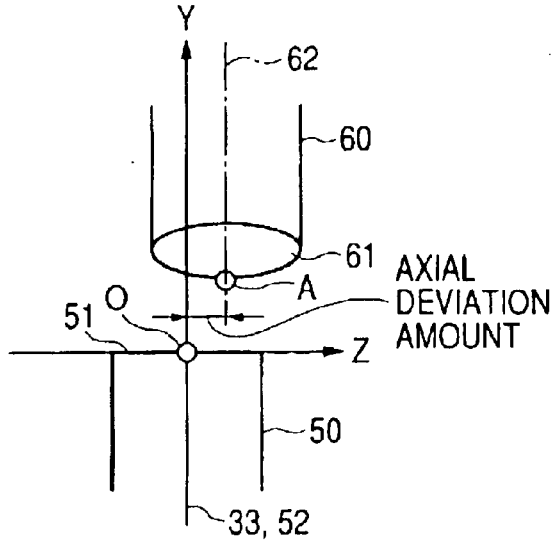

The axial deviation amount is a deviation between the axis 52 of center electrode tip and the axis 62 of ground electrode tip in the Z-axis direction as shown in FIG. 13D. The tolerance of the axial deviation amount is within ±d/2 mm with respect to a standard condition where the axes 52 and 62 coincide with each other on the coordinate plane, where 'd' (mm) represents a diameter of the ground electrode tip 60. On the other hand, the tolerance of the swing amount of the closest point 'A' in the X-axis direction is within ±d/2 mm with respect to −b/2, as shown in FIG. 13C. In each of the above-described axial deviation amount and swing amount, the Y-axis coordinate value of the closest point 'A' is χ(=constant).

The positional relationship between the tips 50 and 60 according to the above-described embodiment is determined for the purpose of suppressing the wear of tips and assuring a practical level of plug life (e.g., equivalent to 100,000 km in terms of vehicle traveling distance). The inventors of this invention obtained this positional relationship through durability tests. The result of conducted tests is explained hereinafter, although the preset invention is not limited to the test result.

The durability test was conducted by varying the axial deviation amount and the swing amount on the spark plug 500 having center electrode tip 50 and ground electrode tip 60 each having a diameter of 0.4 mm, with an initial discharge gap χ of 1.05 mm and the crossing angle θ2 between the center electrode tip axis 52 and the ground electrode tip axis 62 being set to 25°.

The durability of spark plug was tested through a practical engine test equivalent to the vehicle traveling distance of 100,000 km to measure a change of discharge gap G. The engine used in this test is 2,000 cc, 6-cylinder engine which is driven at 5,600 rpm for 180 hours.

Figure 14:
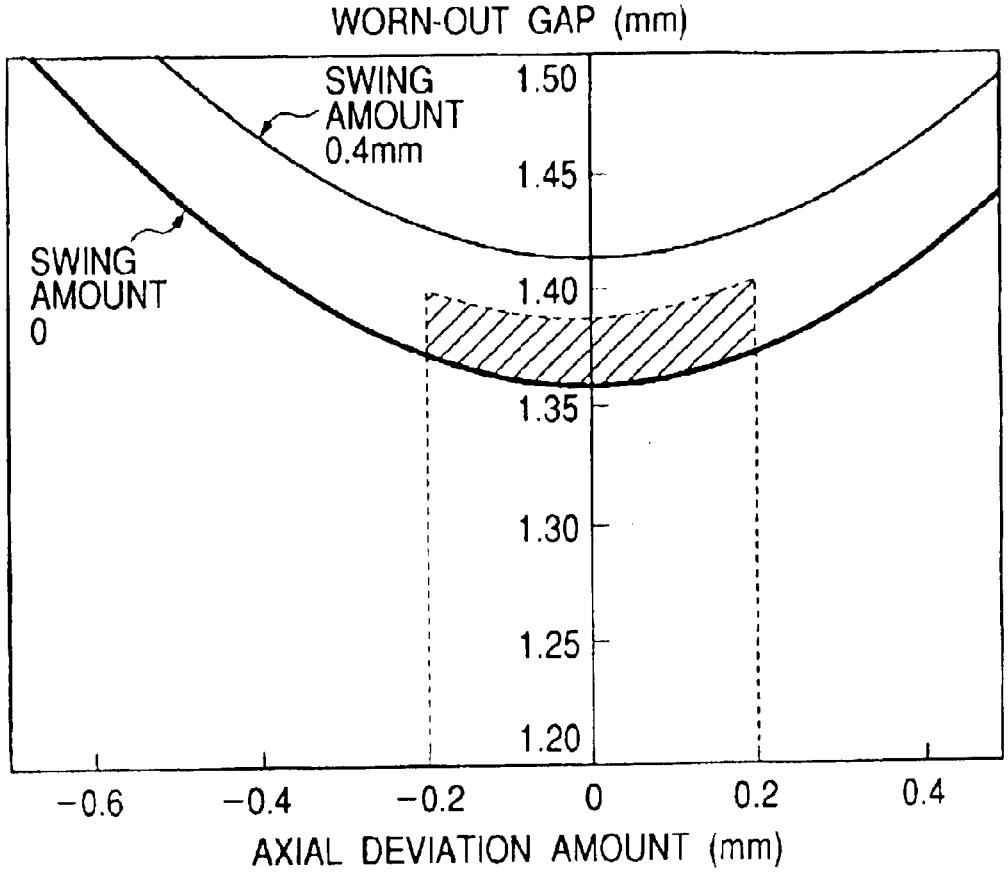
FIG. 14 is a graph showing a relationship between the axial deviation amount and a worn-out gap for each of two swing amounts.

FIG. 14 shows the test result. In FIG. 14, an abscissa represents the axial deviation amount (mm) and an ordinate represents a worn-out gap (i.e., discharge gap G measured after durability test, mm). The relationship is obtained for each of a swing amount=0 mm and a swing amount=0.4 mm.

When the worn-out amount is less than or equal to 1.4 mm, a practical level of requirement can be satisfied. When the discharge gap exceeds 1.4 mm, no spark discharge may occur due to the limited voltage of an ignition coil. From the result shown in FIG. 14, it is concluded that the wear amount can be suppressed in an allowable range throughout a practical level of plug life when both of the axial deviation amount and the swing amount is within ±0.2 mm (i.e.,within ±d/2 mm when 'd' represents the diameter of the ground electrode tip). The resultant relationship shown in FIG. 14 is established under a condition that the initial discharge gap G is approximately 1 mm.

As described above, the fifth embodiment brings the effect of suppressing the wear of center electrode tip 50 and ground electrode tip 60 to assure a practical level of plug life, in addition to the effects brought by the first and second embodiments. Furthermore, the spark plug 500 according to the fifth embodiment is reliable.

Furthermore, the fifth embodiment provides a method for manufacturing the spark plug described in the first and second embodiment. First, the above-described coordinate plane is set. The manufacturing method comprises a step of arranging the center electrode tip 50 and the ground electrode tip 60 so as to satisfy a positional relationship that the point 'A' of ground electrode tip 60 closest to the center electrode tip 50 is expressed by a coordinate value $(-b/2, \chi)$ when the point 'B' on the apical surface 51 of center electrode tip 50 closest to the ground electrode 40 is expressed by a coordinate value $(-b, 0)$, where $\chi$ represents a discharge gap G. The positional relationship between the center electrode tip 50 and the ground electrode tip 60 is determined with the tolerance that each of the above-described axial deviation amount and the above-described swing amount is within $\pm d/2$ mm when 'd' represents the diameter of the ground electrode tip 60.

Other Embodiments

Figure 15A:
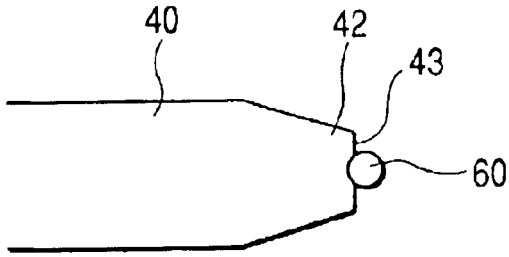
FIGS. 15A and 15B are views explaining a first modification of the spark plug in accordance with the present invention.
Figure 15B:
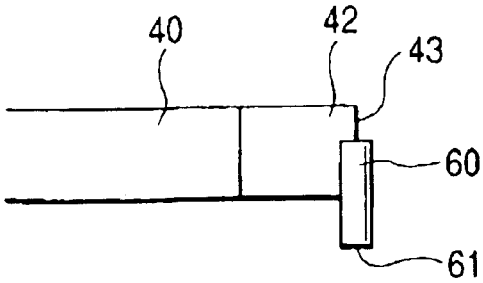

The present invention can be modified in various ways. FIGS. 15A and 15B cooperatively show a first modification proposed for improving the configuration of ground electrode 40. FIG. 15B is a side view corresponding to FIG. 2. FIG. 15A is a plan view showing the ground electrode 40. As shown in FIGS. 15A and 15B, it is preferable that the ground electrode 40 has a tapered shape with a cross-sectional area gradually narrowing with decreasing distance from the end surface 43 of the distal portion 42. This arrangement effectively reduces an area of the ground electrode 40 contacting with the flame kernel, and therefore improve the ignitability of the spark plug.

Figure 16:
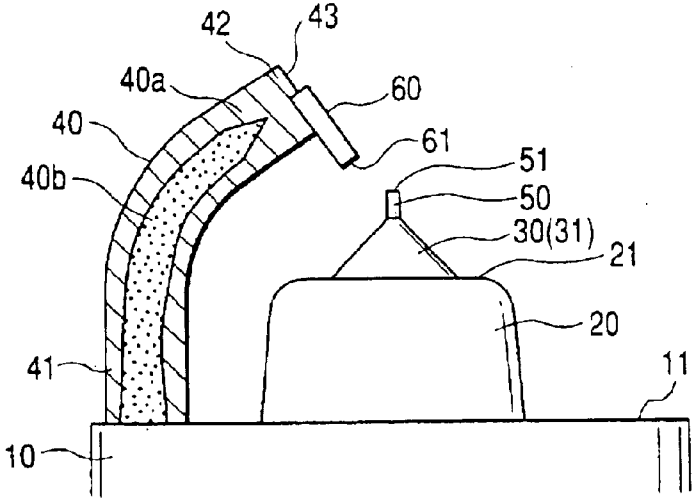
FIG. 16 is a view explaining a second modification of the spark plug in accordance with the present invention.

FIG. 16 shows a second modification proposed for improving the materials and their arrangement of ground electrode 40, wherein the ground electrode 40 is depicted by a cross-sectional view. As shown in FIG. 16, the ground electrode 40 can be constituted so as to have an outer layer 40*a* made of a Ni alloy and an inner layer 40*b* made of a copper or copper alloy. Due to excellent thermal conductivity of a copper or copper alloy, this arrangement effectively improves the heat releasing ability of the ground electrode.

Figure 17:
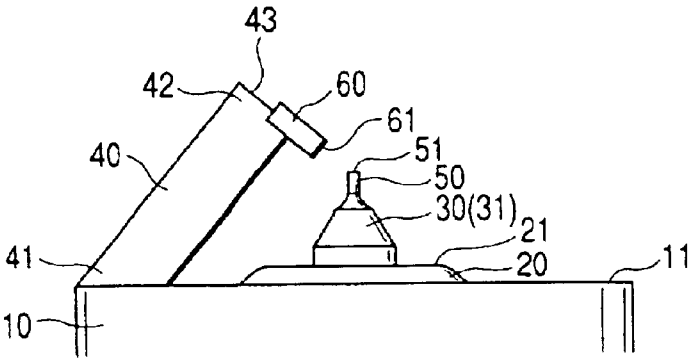
FIG. 17 is a view explaining a third modification of the spark plug in accordance with the present invention.

The ground electrode 40 has a proximal portion 41 fixed to one end 11 of metallic housing 10 and a distal portion 42 extending toward one end 31 of center electrode 30 so that an acute angle is formed between the axis of distal portion 42 and the center electrode axis 33. FIG. 17 is a third modification that provides no bent portion between the proximal portion 41 and the distal portion 42.

Figure 18A:
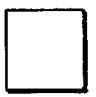
FIGS. 18A to 18E are views showing various cross sections of the columnar ground electrode tip.
Figure 18B:
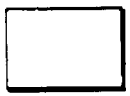
Figure 18C:
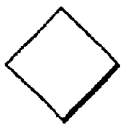
Figure 18D:
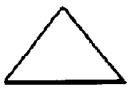
Figure 18E:
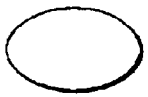

Furthermore, the ground electrode tip 60 can be modified in various ways. For example, as shown in FIGS. 18A to 18E, the cross section of ground electrode tip 60 normal to the tip axis can be configured into a square (FIG. 18A), a rectangle (FIG. 18B), a diamond (FIG. 18C), a triangle (FIG. 18D), and an oval (FIG. 18E). In any case, the cross-sectional area is in the range from 0.07 $mm^2$ to 1.13 $mm^2$.

The material for the center electrode tip 50 and the ground electrode tip 60 is not limited to a noble metal. Therefore, the center electrode tip 50 and the ground electrode tip 60 can be made by using the base material of each electrode (center electrode 30 and ground electrode 40).

What is claimed is:

1. A spark plug comprising:

a cylindrical metallic housing;

a center electrode accommodated in said metallic housing, with one end protruding and extending from one end of said metallic housing;

a center electrode tip fixed to said one end of said center electrode and extending in the same direction as an axis of said center electrode;

a ground electrode having a proximal portion fixed to said one end of the metallic housing and a distal portion extending toward said one end of said center electrode; and a columnar ground electrode tip fixed to an end surface of said distal portion of the ground electrode, with an apical surface of said ground electrode tip opposed to an apical surface of said center electrode tip via a discharge gap, wherein an acute angle is formed between an axis of said distal portion of the ground electrode and said axis of said center electrode when said ground electrode is projected on a virtual plane including said axis of the center electrode and a cross-sectional centroid of a proximal end of said ground electrode where the ground electrode is fixed to said metallic housing, said ground electrode tip extends along an axis crossing with the axis of the distal portion of the ground electrode, so that said ground electrode tip protrudes from the end surface of the distal portion of said ground electrode and extends toward said center electrode, an axis of said center electrode tip is in a cross or skew relationship with an axis of said ground electrode tip, said round electrode tip protrudes toward said center electrode by a protruding length in a range from 0.3 mm to 1.5 mm with respect to the side surface of said distal portion of said ground electrode, said center electrode tip has a cylindrical shape with a cross sectional area in a range from 0.07 $mm^2$ to 0.79 $mm^2$, and said around electrode tip has a cylindrical shape with a cross sectional area in a range from 0.07 $mm^2$ to 1.13 $mm^2$.

2. The spark plug in accordance with claim 1, wherein a crossing angle between said axis of said center electrode tip and said axis of said ground electrode tip is in an angular range from 5° to 70°.

3. A spark plug comprising:

a cylindrical metallic housing;

a center electrode accommodated in said metallic housing, with one end protruding and extending from one end of said metallic housing;

a center electrode tip fixed to said one end of said center electrode and extending in the same direction as an axis of said center electrode;

a ground electrode having a proximal portion fixed to said one end of the metallic housing and a distal portion extending toward said one end of said center electrode; and a columnar ground electrode tip fixed to an end surface of said distal portion of the ground electrode, with an apical surface of said around electrode tip opposed to an apical surface of said center electrode tip via a discharge gap, wherein an acute angle is formed between an axis of said distal portion of the ground electrode and said axis of said center electrode when said around electrode is projected on a virtual plane including said axis of the center electrode and a cross-sectional centroid of a proximal end of said ground electrode where the around electrode is fixed to said metallic housing, said around electrode tip extends along an axis crossing with the axis of the distal portion of the ground electrode, so that said ground electrode tip protrudes from the end surface of the distal portion of said ground electrode and extends toward said center electrode, an axis of said center electrode tin is in a cross or skew relationship with an axis of said ground electrode tip, an X axis represents said apical surface of said center electrode tip and a Y axis represents the axis of said center electrode tip in a coordinate plane including both of the axis of said center electrode tip and the axis of said ground electrode tip, with a crossing point of said X axis and said Y axis being an origin (0, 0) of said coordinate plane, a point 'A' of said ground electrode tip closest to said center electrode tip is expressed by a coordinate value (−b/2, $\chi$) when a point 'B' on the apical surface of said center electrode tip closest to said ground electrode is expressed by a coordinate value (−b, 0), where $\chi$ represents a discharge gap, and an axial deviation amount between the axis of said center electrode tip and the axis of said ground electrode tip is within ±d/2 in a direction normal to said coordinate plane, and a swing amount of said closest point 'A' is within ±d/2 mm in a direction parallel to said $\chi$ axis, where 'd' represents a diameter of said ground electrode tip.

4. A spark plug comprising:

a cylindrical metallic housing;

a center electrode accommodated in said metallic housing, with one end protruding and extending from one end of said metallic housing;

a center electrode tip fixed to said one end of said center electrode and extending in the same direction as an axis of said center electrode;

a ground electrode having a proximal portion fixed to said one end of the metallic housing and a distal portion extending toward said one end of said center electrode so that an acute angle is formed between an axis of said distal portion of the ground electrode and said axis of said center electrode; and a columnar ground electrode tip fixed to an end surface of said distal portion of the ground electrode or fixed to a side surface of said distal portion of the ground electrode facing to said center electrode, with an apical surface of said ground electrode tip opposed to an apical surface of said center electrode tip via a discharge gap, wherein said ground electrode tip extends along an axis crossing with the axis of the distal portion of the ground electrode, so that said ground electrode tip protrudes from the end surface of the distal portion of said ground electrode and extends toward said center electrode, a crossing angle between an axis of the center electrode tip and an axis of the ground electrode tip is in an angular range from 5° to 70°, a fixing portion of said ground electrode tip to said ground electrode is far from said metallic housing in an axial direction of said center electrode compared with the apical surface of said center electrode tip, said ground electrode tip protrudes toward said center electrode by a protruding length in a range from 0.3 mm to 1.5 mm with respect to the side surface of said distal portion of said around electrode, said center electrode tip has a cylindrical shape with a cross sectional area in a range from 0.07 $mm^2$ to 0.79 $mm^2$, and said around electrode tip has a cylindrical shape with a cross sectional area in a rang from 0.07 $mm^2$ to 1.13 $mm^2$.

5. A spark plug comprising:

a cylindrical metallic housing;

a center electrode accommodated in said metallic housing, with one end protruding and extending from one end of said metallic housing;

a center electrode tip fixed to said one end of said center electrode and extending in the same direction as an axis of said center electrode;

a around electrode having a proximal portion fixed to said one end of the metallic housing and a distal portion extending toward said one end of said center electrode so that an acute angle is formed between an axis of said distal portion of the ground electrode and said axis of said center electrode; and a columnar ground electrode tip fixed to an end surface of said distal portion of the ground electrode or fixed to a side surface or said distal portion of the around electrode facing to said center electrode, with an apical surface of said around electrode tip opposed to an apical surface of said center electrode tip via a discharge gap, wherein said ground electrode tip extends along an axis crossing with the axis of the distal portion of the around electrode, so that said around electrode tip protrudes from the end surface of the distal portion of said ground electrode and extends toward said center electrode, a crossing angle between an axis of the center electrode tip and an axis of the around electrode tip is in an angular range from 5° to 70°, a fixing portion of said around electrode tin to said ground electrode is far from said metallic housing in an axial direction of said center electrode compared with the apical surface of said center electrode tip, an X axis represents said apical surface of said center electrode tip and a Y axis represents the axis of said center electrode tip in a coordinate plane including both of the axis of said center electrode tip and the axis of said ground electrode tip, with a crossing point of said X axis and said Y axis being an origin (0, 0) of said coordinate plane, a point 'A' of said ground electrode tip closest to said center electrode tip is expressed by a coordinate value (−b/2, y) when a point 'B' on the apical surface of said center electrode tip closest to said ground electrode is expressed by a coordinate value (−b, 0), where $\chi$ represents a discharge gap, and an axial deviation amount between the axis of said center electrode tip and the axis of said ground electrode tip is within ±d/2 in a direction normal to said coordinate plane, and a swing amount of said closest point 'A' is within ±d/2 mm in a direction parallel to said X axis, where 'd' represents a diameter of said ground electrode tip.

6. A spark plug comprising:

a cylindrical metallic housing;

a center electrode accommodated in said metallic housing, with one end protruding and extending from one end of said metallic housing;

a center electrode tip fixed to said one end of said center electrode and extending in the same direction as an axis of said center electrode;

a ground electrode having a proximal portion fixed to said one end of the metallic housing and a distal portion extending toward said one end of said center electrode; and a columnar ground electrode tip fixed to a side surface of said distal portion of the ground electrode facing to the center electrode, with an apical surface of said ground electrode tip opposed to an apical surface of said center electrode tip via a discharge gap, wherein an acute angle is formed between an axis of said distal portion of the ground electrode and said axis of said center electrode when said ground electrode is projected on a virtual plane including said axis of the center electrode and a cross-sectional centroid of a proximal end of said ground electrode where the ground electrode is fixed to said metallic housing, an axis of said center electrode tip is in a cross or skew relationship with an axis of said ground electrode tip, said ground electrode tip protrudes toward said center electrode by a protruding length in a range from 0.3 mm to 1.5 mm with respect to the side surface of said distal portion of said ground electrode, said center electrode tin has a cylindrical shape with a cross sectional area in a range from 0.07 $mm^2$ to 0.79 $mm^2$, and said ground electrode tip has a cylindrical shape with a cross sectional area in a range from 0.07 $mm^2$ to 1.13 $mm^2$.

7. The spark plug in accordance with claim 6, wherein a crossing angle between said axis of said center electrode tip and said axis of said ground electrode tip is in an angular range from 5° to 70°.

8. A spark plug comprising:

a cylindrical metallic housing;

a center electrode accommodated in said metallic housing, with one end protruding and extending from one end of said metallic housing;

a center electrode tip fixed to said one end of said center electrode and extending in the same direction as an axis of said center electrode;

a ground electrode having a proximal portion fixed to said one end of the metallic housing and a distal portion extending toward said one end of said center electrode; and a columnar ground electrode tip fixed to a side surface of said distal portion of the ground electrode facing to the center electrode, with an apical surface of said ground electrode tip opposed to an apical surface of said center electrode tip via a discharge gap, wherein an acute angle is formed between an axis of said distal portion of the ground electrode and said axis of said center electrode when said around electrode is projected on a virtual plane including said axis of the center electrode and a cross-sectional centroid of a proximal end of said ground electrode where the ground electrode is fixed to said metallic housing, an axis of said center electrode tip is in a cross or skew relationship with an axis of said ground electrode tip, an X axis represents said apical surface of said center electrode tip and a Y axis represents the axis of said center electrode tip in a coordinate plane including both of the axis of said center electrode tip and the axis of said ground electrode tip, with a crossing point of said X axis and said Y axis being an origin (0, 0) of said coordinate plane, a point 'A' of said ground electrode tip closest to said center electrode tip is expressed by a coordinate value $(-b/2, \chi)$ when a point 'B' on the apical surface of said center electrode tip closest to said ground electrode is expressed by a coordinate value $(-b, 0)$, where $\chi$ represents a discharge gap, and an axial deviation amount between the axis of said center electrode tip and the axis of said ground electrode tip is within $\pm d/2$ in a direction normal to said coordinate plane, and a swing amount of said closest point 'A' is within $\pm d/2$ mm in a direction parallel to said X axis, where 'd' represents a diameter of said ground electrode tip.

9. A spark plug comprising:

a cylindrical metallic housing;

a center electrode accommodated in said metallic housing, with one end protruding and extending from one end of said metallic housing;

a center electrode tip fixed to said one end of said center electrode and extending outward from said center electrode;

a ground electrode having a proximal portion fixed to said one end of the metallic housing and a distal portion extending toward said one end of said center electrode; and a columnar ground electrode tip fixed to an end surface of said distal portion of the ground electrode, with an apical surface of said ground electrode tip opposed to an apical surface of said center electrode tip via a discharge gap, wherein an acute angle is formed between an axis of said distal portion of the ground electrode and said axis of said center electrode when said ground electrode is projected on a virtual plane including said axis of the center electrode and a cross-sectional centroid of a proximal end of said ground electrode where the ground electrode is fixed to said metallic housing, said ground electrode tip extends along an axis crossing with the axis of the distal portion of the ground electrode, so that said ground electrode tip protrudes from the end surface of said distal portion of said ground electrode and extends toward said center electrode, the axis of said center electrode is in a cross or skew relationship with an axis of said ground electrode tip, said ground electrode tip protrudes toward said center electrode by a protruding length in a range from 0.3 mm to 1.5 mm with respect to the side surface of said distal portion of said ground electrode, said center electrode tip has a cylindrical shape with a cross sectional area in a range from 0.07 $mm^2$ to 0.79 $mm^2$, and said ground electrode tin has a cylindrical shape with a cross sectional area in a range from 0.07 $mm^2$ to 1.13 $mm^2$.

10. The spark plug in accordance with claim 9, wherein a crossing angle between said axis of said center electrode and said axis of said ground electrode tip is in an angular range from 5° to 70°.

11. A spark plug comprising:

a cylindrical metallic housing;

a center electrode accommodated in said metallic housing, with one end protruding and extending from one end of said metallic housing;

a center electrode tip fixed to said one end of said center electrode and extending outward from said center electrode;

a ground electrode having a proximal portion fixed to said one end of the metallic housing and a distal portion extending toward said one end of said center electrode; and a columnar ground electrode tip fixed to a side surface of said distal portion of the ground electrode facing to said center electrode, with an apical surface of said ground electrode tip opposed to an apical surface of said center electrode tip via a discharge gap, wherein an acute angle is formed between an axis of said distal portion of the ground electrode and said axis of said center electrode when said ground electrode is projected on a virtual plane including said axis of the center electrode and a cross-sectional centroid of a proximal end of said ground electrode where the ground electrode is fixed to said metallic housing, the axis of said center electrode is in a cross or skew relationship with an axis of said ground electrode tip, said around electrode tip protrudes toward said center electrode by a protruding length in a range from 0.3 mm to 1.5 mm with respect to the side surface of said distal portion of said around electrode, said center electrode tip has a cylindrical shape with a cross sectional area in a range from 0.07 $mm^2$ to 0.79 $mm^2$, and said ground electrode tip has a cylindrical shape with a cross sectional area in a range from 0.07 $mm^2$ to 1.13 $mm^2$.

12. The spark plug in accordance with claim 11, wherein a crossing angle between said axis of said center electrode and said axis of said ground electrode tip is in an angular range from 5° to 70°.

13. The spark plug in accordance with claim 1, wherein said ground electrode has a tapered shape with a cross-sectional area gradually narrowing with decreasing distance from said end surface.

14. The spark plug in accordance with claim 1, wherein said ground electrode has an outer layer made of a Ni alloy and an inner layer made of a copper or copper alloy.

15. The spark plug in accordance with claim 1, wherein said center electrode tip and said ground electrode tip are made of a Pt alloy including at least one additive selected from the group consisting of Ir, Ni, Rh, W, Pd, Ru and Os.

16. The spark plug in accordance with claim 15, wherein a material for said center electrode tip and said ground electrode tip is a Pt alloy containing at least one additive selected from the group consisting of Ir (50 weight % or less), Ni (40 weight % or less), Rh (50 weight % or less), W (30 weight % or less), Pd (40 weight % or less), Ru (30 weight % or less), and Os (20 weight % or less).

17. The spark plug in accordance with claim 1, wherein said center electrode tip and said ground electrode tip are made of a Ir alloy including at least one additive selected from the group consisting of Rh, Pt, Ni, W, Pd, Ru and Os.

18. The spark plug in accordance with claim 17, wherein a material for said center electrode tip and said ground electrode tip is a Ir alloy containing at least one additive selected from the group consisting of Rh (50 weight % or less), Pt (50 weight % or less), Ni (40 weight % or less), W (30 weight % or less), Pd (40 weight % or less), Ru (30 weight % or less), and Os (20 weight % or less).

19. A method for manufacturing a spark plug, said spark plug comprising:

a cylindrical metallic housing;

a center electrode accommodated in said metallic housing, with one end protruding and extending from one end of said metallic housing;

a center electrode tip fixed to said one end of said center electrode and extending in the same direction as an axis of said center electrode;

a ground electrode having a proximal portion fixed to said one end of the metallic housing and a distal portion extending toward said one end of said center electrode; and a columnar ground electrode tip fixed to an end surface of said distal portion of the ground electrode, with an apical surface of said ground electrode tip opposed to an apical surface of said center electrode tip via a discharge gap, wherein an acute angle is formed between an axis of said distal portion of the ground electrode and said axis of said center electrode when said ground electrode is projected on a virtual plane including said axis of the center electrode and a cross-sectional centroid of a proximal end of said ground electrode where the ground electrode is fixed to said metallic housing;

said ground electrode tip extends along an axis crossing with the axis of the distal portion of the ground electrode, so that said ground electrode tip protrudes from the end surface of the distal portion of said ground electrode and extends toward said center electrode; and an axis of said center electrode tip is in a cross or skew relationship with an axis of said ground electrode tip, said manufacturing method comprising the steps of:

assuming an X axis representing said apical surface of said center electrode tip and a Y axis representing the axis of said center electrode tip in a coordinate plane including both of the axis of said center electrode tip and the axis of said ground electrode tip, with a crossing point of said X axis and said Y axis being an origin (0, 0) of said coordinate plane, and arranging said center electrode tip and said ground electrode tip so as to satisfy a positional relationship that a point 'A' of said ground electrode tip closest to said center electrode tip is expressed by a coordinate value $(-b/2, \chi)$ when a point 'B' on the apical surface of said center electrode tip closest to said ground electrode is expressed by a coordinate value $(-b, 0)$, where $\chi$ represents a discharge gap, wherein the positional relationship between said center electrode tip and said ground electrode tip is determined with a tolerance that an axial deviation amount between the axis of said center electrode tip and the axis of said ground electrode tip is within $\pm d/2$ in a direction normal to said coordinate plane and a swing amount of said closest point 'A' is within $\pm d/2$ in a direction parallel to said X axis, where 'd' represents a diameter of said ground electrode tip.

20. A method for manufacturing a spark plug, said spark plug comprising:

a cylindrical metallic housing;

a center electrode accommodated in said metallic housing, with one end protruding and extending from one end of said metallic housing;

a center electrode tip fixed to said one end of said center electrode and extending in the same direction as an axis of said center electrode;

a ground electrode having a proximal portion fixed to said one end of the metallic housing and a distal portion extending toward said one end of said center electrode so that an acute angle is formed between an axis of said distal portion of the ground electrode and said axis of said center electrode; and a columnar ground electrode tip fixed to an end surface of said distal portion of the ground electrode or fixed to a side surface of said distal portion of the ground electrode facing to said center electrode, with an apical surface of said ground electrode tip opposed to an apical surface of said center electrode tip via a discharge gap, wherein said ground electrode tip extends along an axis crossing with the axis of the distal portion of the ground electrode, so that said ground electrode tip protrudes from the end surface of the distal portion of said ground electrode and extends toward said center electrode;

a crossing angle between an axis of the center electrode tip and an axis of the ground electrode tip is in an angular range from 5° to 70°; and a fixing portion of said ground electrode tip to said ground electrode is far from said metallic housing in an axial direction of said center electrode compared with the apical surface of said center electrode tip, said manufacturing method comprising the steps of:

assuming an X axis representing said apical surface of said center electrode tip and a Y axis representing the axis of said center electrode tip in a coordinate plane including both of the axis of said center electrode tip and the axis of said ground electrode tip, with a crossing point of said X axis and said Y axis being an origin (0, 0) of said coordinate plane, and arranging said center electrode tip and said ground electrode tip so as to satisfy a positional relationship that a point 'A' of said ground electrode tip closest to said center electrode tip is expressed by a coordinate value $(-b/2, \chi)$ when a point 'B' on the apical surface of said center electrode tip closest to said ground electrode is expressed by a coordinate value $(-b, 0)$, where $\chi$ represents a discharge gap, wherein the positional relationship between said center electrode tip and said ground electrode tip is determined with a tolerance that an axial deviation amount between the axis of said center electrode tip and the axis of said ground electrode tip is within $\pm d/2$ in a direction normal to said coordinate plane and a swing amount of said closest point 'A' is within $\pm d/2$ in a direction parallel to said X axis, where 'd' represents a diameter of said ground electrode tip.

21. A method for manufacturing a spark plug, said spark plug comprising:

a cylindrical metallic housing;

a center electrode accommodated in said metallic housing, with one end protruding and extending from one end of said metallic housing;

a center electrode tip fixed to said one end of said center electrode and extending in the same direction as an axis of said center electrode;

a ground electrode having a proximal portion fixed to said one end of the metallic housing and a distal portion extending toward said one end of said center electrode; and a columnar ground electrode tip fixed to a side surface of said distal portion of the ground electrode facing to the center electrode, with an apical surface of said ground electrode tip opposed to an apical surface of said center electrode tip via a discharge gap, wherein an acute angle is formed between an axis of said distal portion of the ground electrode and said axis of said center electrode when said ground electrode is projected on a virtual plane including said axis of the center electrode and a cross-sectional centroid of a proximal end of said ground electrode where the ground electrode is fixed to said metallic housing; and an axis of said center electrode tip is in a cross or skew relationship with an axis of said ground electrode tip, said manufacturing method comprising the steps of:

assuming an X axis representing said apical surface of said center electrode tip and a Y axis representing the axis of said center electrode tip in a coordinate plane including both of the axis of said center electrode tip and the axis of said ground electrode tip, with a crossing point of said X axis and said Y axis being an origin (0, 0) of said coordinate plane, and arranging said center electrode tip and said ground electrode tip so as to satisfy a positional relationship that a point 'A' of said ground electrode tip closest to said center electrode tip is expressed by a coordinate value $(-b/2, \chi)$ when a point 'B' on the apical surface of said center electrode tip closest to said ground electrode is expressed by a coordinate value $(-b, 0)$, where $\chi$ represents a discharge gap, wherein the positional relationship between said center electrode tip and said ground electrode tip is determined with a tolerance that an axial deviation amount between the axis of said center electrode tip and the axis of said ground electrode tip is within $\pm d/2$ in a direction normal to said coordinate plane and a swing amount of said closest point 'A' is within $\pm d/2$ in a direction parallel to said X axis, where 'd' represents a diameter of said ground electrode tip.

22. The spark plug in accordance with any one of claims 1, 4, 6, 9 and 11, wherein said electrode tip is fixed to said electrode by welding.

23. The spark plug in accordance with any one of claims 1, 4, 6, 9 and 11, wherein said electrode tip is a rod.

24. The spark plug in accordance with claim 4, wherein said crossing angle between the axis of the center electrode tip and an axis of the ground electrode tip is in an angular range from 10° to 60°.

25. The spark plug in accordance with any one of claims 1, 4, 6, 9 and 11, wherein said protruding length of said ground electrode tip is in a range from 0.5 mm to 1.0 mm.

26. The spark plug in accordance with any one of claims 1, 4, 6, 9 and 11, wherein the cross section of said ground electrode tip is in a range from 0.13 $mm^2$ to 0.79 $mm^2$.

* * * * *